US005682007A

United States Patent [19]

Dobbins

[11] Patent Number: 5,682,007

[45] Date of Patent: *Oct. 28, 1997

[54] SELF-REGULATING LINEAR INERTIAL GUIDANCE BREECH-LOCK RELEASE AND CYCLING MECHANISM FOR REPEATING FIREARMS

[75] Inventor: David R. Dobbins, LaGrange, Ga.

[73] Assignee: Hesco, Inc., LaGrange, Ga.

[ * ] Notice: The term of this patent shall not extend beyond the expiration date of Pat. No. 5,447,092.

[21] Appl. No.: 476,350

[22] Filed: Jun. 7, 1995

Related U.S. Application Data

[63] Continuation-in-part of Ser. No. 203,033, Feb. 28, 1994, Pat. No. 5,447,092.

[51] Int. Cl.[6] ..... F41A 3/44

[52] U.S. Cl. ..... 89/187.02; 42/16

[58] Field of Search ..... 89/187.02, 187.01, 89/173; 42/14, 16, 17

[56] References Cited

U.S. PATENT DOCUMENTS

| | | | |
|---|---|---|---|
| 2,435,444 | 2/1948 | Johnsen | 114/239 |
| 2,651,974 | 9/1953 | Simpson | 89/187.01 |
| 3,293,347 | 12/1966 | Wooding | 13/14 |
| 3,507,528 | 4/1970 | Desmarchais | 287/124 |
| 3,640,553 | 2/1972 | Blatt | 285/277 |
| 3,738,219 | 6/1973 | Febres | 89/187.02 |
| 3,761,117 | 9/1973 | Shendure | 285/277 |
| 3,848,510 | 11/1974 | Wolpert | 89/187.02 |
| 4,231,670 | 11/1980 | Knoski | 403/11 |
| 4,637,914 | 1/1987 | Boyle et al. | 376/353 |
| 4,859,110 | 8/1989 | Dommel | 403/325 |
| 4,867,039 | 9/1989 | Dobbins | 89/127 |
| 4,922,640 | 5/1990 | Toombs | 42/16 |
| 5,050,467 | 9/1991 | Brown et al. | 89/187.02 |
| 5,259,137 | 11/1993 | Blenk et al. | 42/16 |
| 5,458,046 | 10/1995 | Blenk et al. | 89/190 |

OTHER PUBLICATIONS

Rick Jamison, *Shooting Times*, Feb. 1995, pp. 65–70, 91.

*Primary Examiner*—J. Woodrow Eldred

*Attorney, Agent, or Firm*—Birch, Stewart, Kolasch & Birch, LLP

[57] ABSTRACT

A breech bolt lock-up device for a firearm absorbs linear inertial forces and utilizes the absorbed inertial force to linearly cycle the firearm. The lock-up device includes an inner lock sleeve and an outer lock sleeve. A locking device will releasably lock the inner lock sleeve with the outer lock sleeve. A cam member is axially aligned with the inner lock sleeve and the outer lock sleeve. The cam member is engagable with the locking device for releasing engagement between the inner lock sleeve and the outer lock sleeve. The cam member linearly reciprocates relative to the gun barrel. A cam spring is provided for storing linear inertia energy when the cam member moves forward. A recoil spring will store linear inertia energy when the cam member moves rearwardly.

20 Claims, 18 Drawing Sheets

5
18'
4'

16
3'
6
4'
2'
9'

5
19
15
7
6
14
11
13'
10
3'
9'
4'
12
2'
16
17
22
20
21
33
1'
39'

SELF-REGULATING LINEAR INERTIAL GUIDANCE BREECH-LOCK RELEASE AND CYCLING MECHANISM FOR REPEATING FIREARMS

This application is a continuation-in-part of application Ser. No. 08/203,033 filed Feb. 28, 1994, now U.S. Pat. No. 5,447,092, the entire contents of which are hereby incorporated by reference.

BACKGROUND OF THE INVENTION

1. Field of the Invention

The present invention relates to a firearm having a lock-up mechanism to withstand high chamber pressure when the firearm is discharged and also to store inertial force from recoil which is utilized by linear reaction to unlock the mechanism and cycle ammunition, without rotational movement. It should be noted that the word firearm is being used in this application to mean any device which discharges a projectile by use of an explosive charge.

2. Description of the Background Art

Prior art firearms utilize a barrel mounted gas release system operatively connected to the bolt for the release of lock-up by rotation of interlocking lugs and to move rearwardly whereby loading of ammunition may automatically be carried out after a first round is fired. Such gas cycling methods require a complex means of connection to the bolt and require exposed locking surfaces specifically located with the bolt, which are subject to stoppage by debris. These connections are difficult to manufacture, especially when interchangeability of parts are required such as for organizational or departmental use.

Therefore, it is desirable to have a mechanism which does not require a specific location in the firearm, gas connecting means, or rotating locking surfaces, and which can be a sealed universal unit which is easily replaceable and not subject to interruption by debris, which would improve the reliability, manufacture and maintenance of the firearm.

The present invention utilizes a linear inertial guidance breech-lock release and cycling mechanism for repeating firearms heretofore unknown in the prior art.

SUMMARY OF THE INVENTION

Accordingly, it is a primary objective of the present invention to provide a lock-up device which withstands extreme pressures of a discharging firearm.

Another object of the present invention is to provide a lock-up device which is self-adjusting for varied recoil.

An additional object of the present invention is to provide a lock-up device which comprises a sealed unit which is protected from debris.

It is another objective of the present invention to provide a lock-up device which allows the use of compressive quality materials such as ceramics.

It is yet another object of the present invention to provide cycling of the mechanism, as in the feeding of ammunition in a firearm, by linear inertial guidance.

Further, it is an objective of the present invention to provide cycling of the mechanism by linear inertial guidance assisted by another available force in the device such as expanding gas in the barrel of a discharged firearm.

These and other objects of the present invention are obtained by providing a breech bolt lock-up release and cycling mechanism, for use in a firearm, comprising: an inner lock sleeve; an outer lock sleeve axially aligned with said inner lock sleeve; locking means for releasably locking said inner lock sleeve with said outer lock sleeve; a cam member axially aligned with said inner lock sleeve and said outer lock sleeve, and engagable with said locking means for releasing engagement between said inner lock sleeve and said outer lock sleeve, said cam member linearly reciprocates in a forward and rearward direction relative to a gun barrel; a cam spring for storing linear inertia energy when said cam member moves forward; and a recoil spring for storing linear inertia energy when said cam member moves rearward.

Further scope of applicability of the present invention will become apparent from the detailed description given hereinafter. However, it should be understood that the detailed description and specific examples, while indicating preferred embodiments of the invention, are given by way of illustration only, since various changes and modifications within the spirit and scope of the invention will become apparent to those skilled in the art from this detailed description.

BRIEF DESCRIPTION OF THE DRAWINGS

The present invention will become more fully understood from the detailed description given hereinbelow and the accompanying drawings which are given by way of illustration only, and thus are not limitative of the present invention, and wherein.

DETAILED DESCRIPTION OF THE PREFERRED EMBODIMENTS

Figure 1:
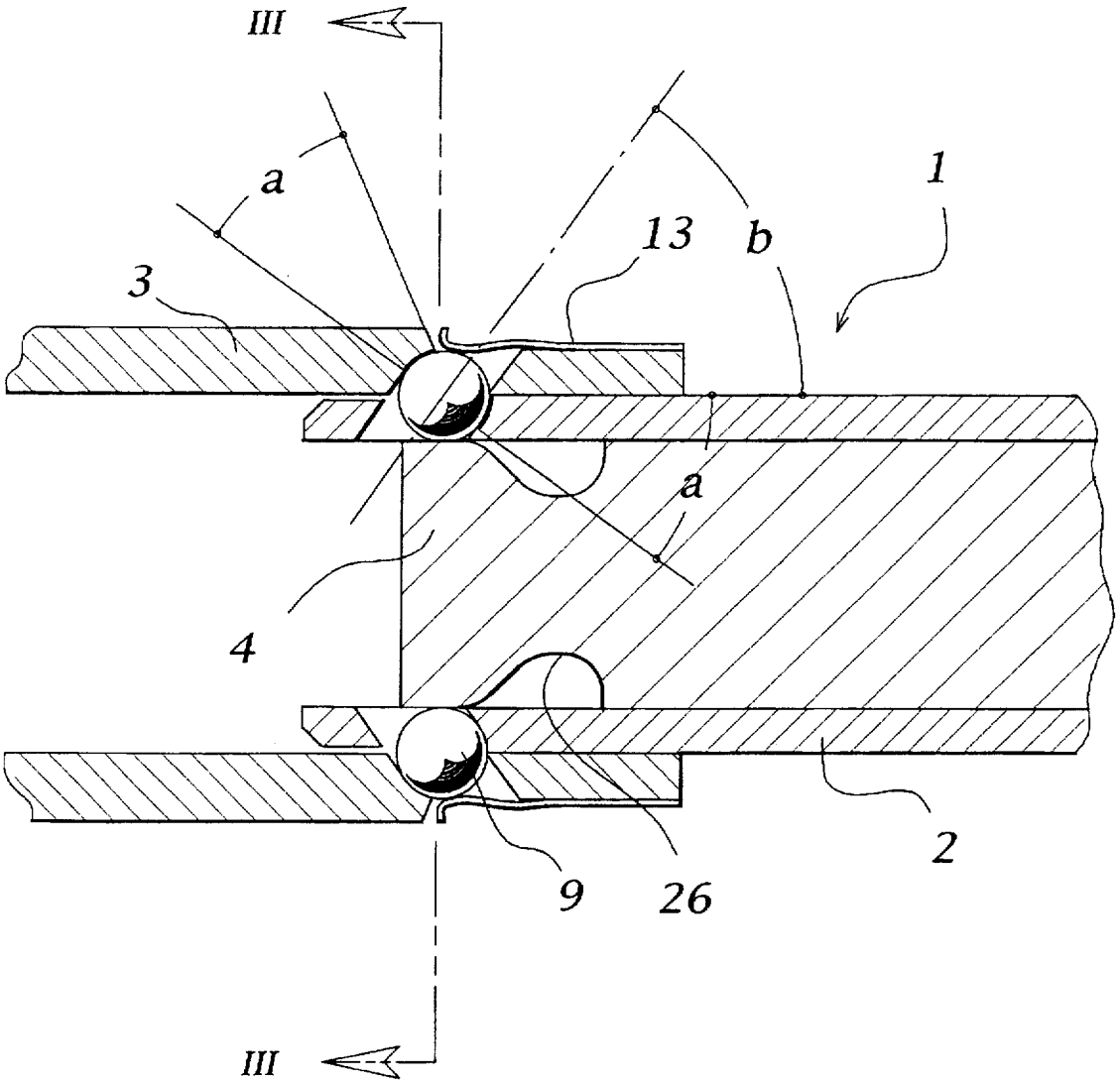
FIG. 1 is a side sectional view of a lock-up device, according to the present invention, wherein the lock balls are in a locked position.
Figure 2:
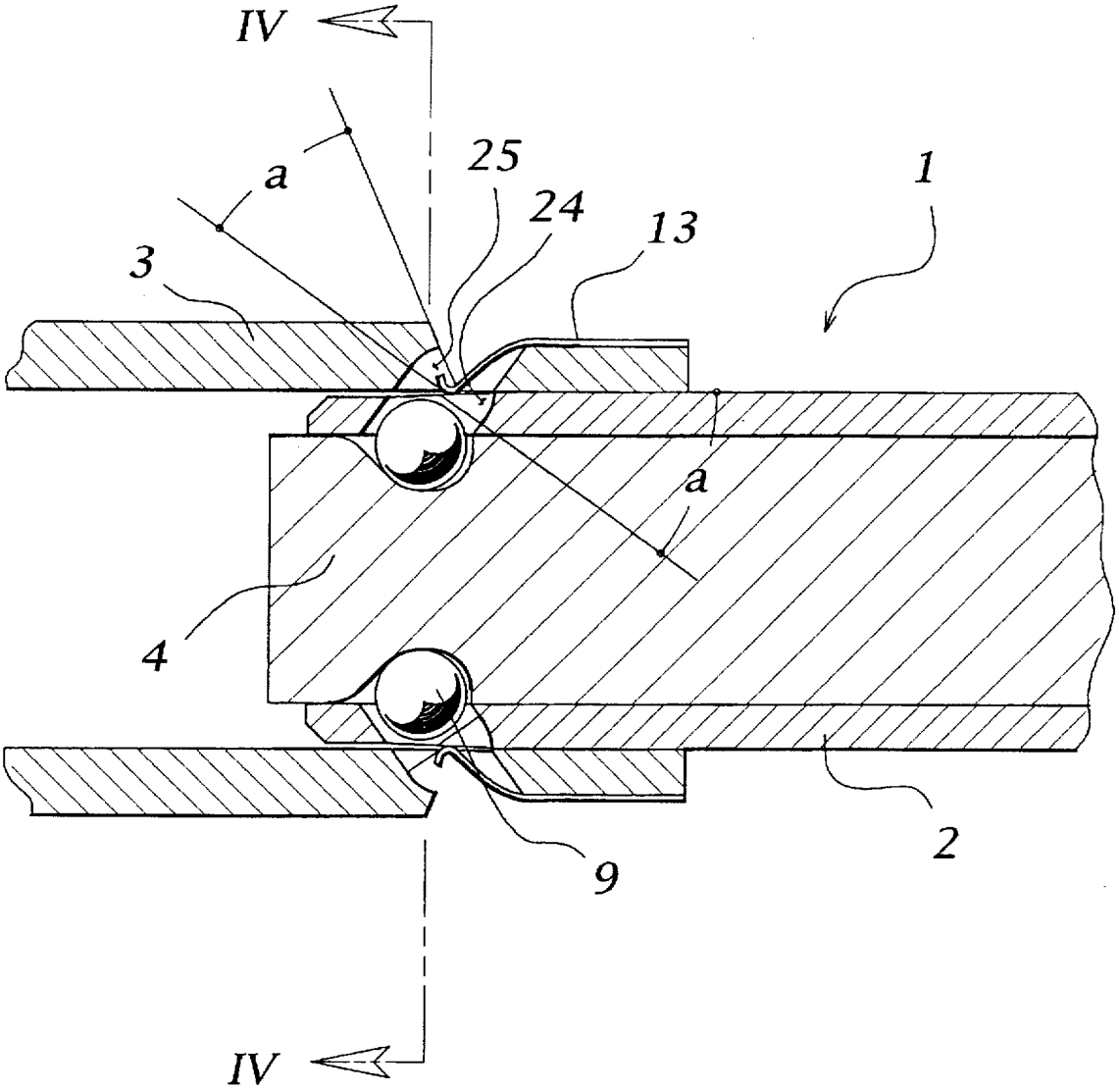
FIG. 2 is a side sectional view of the lock-up device in FIG. 1, wherein the lock balls are in an unlocked position.
Figure 3:
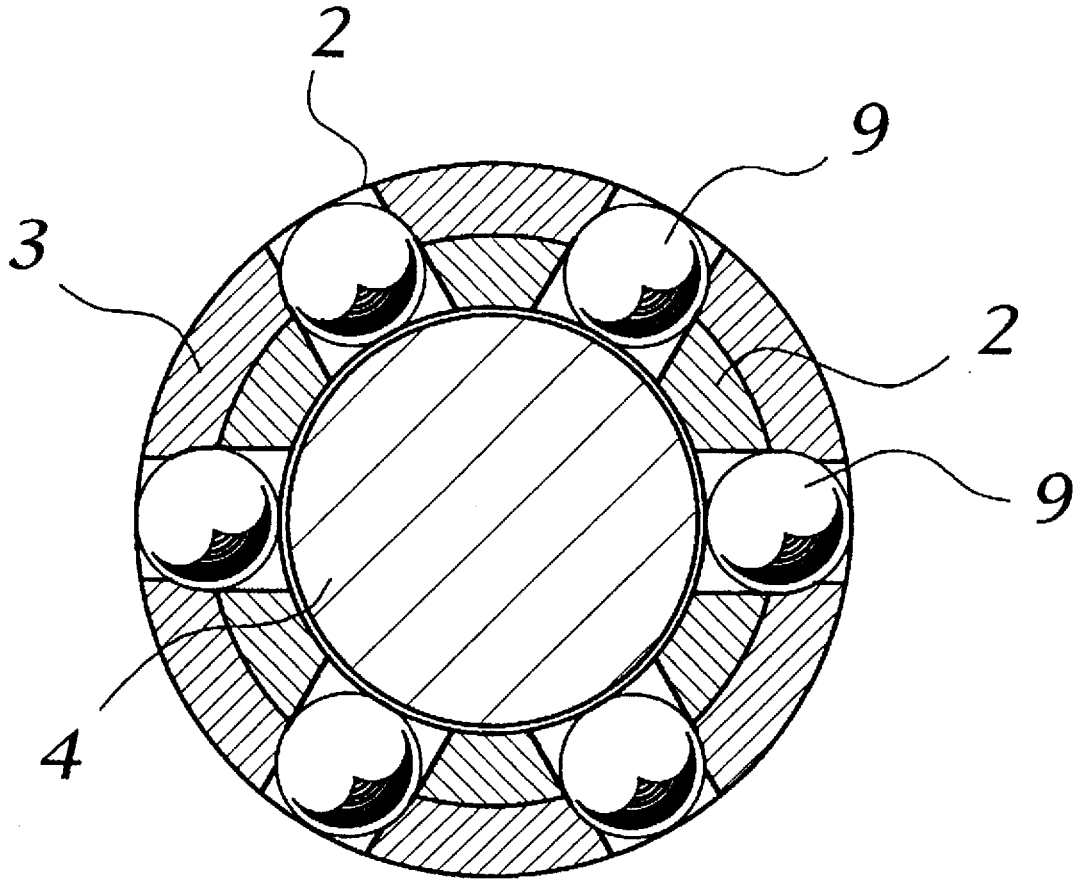
FIG. 3 is a cross sectional view along line III—III in FIG. 1.
Figure 4:
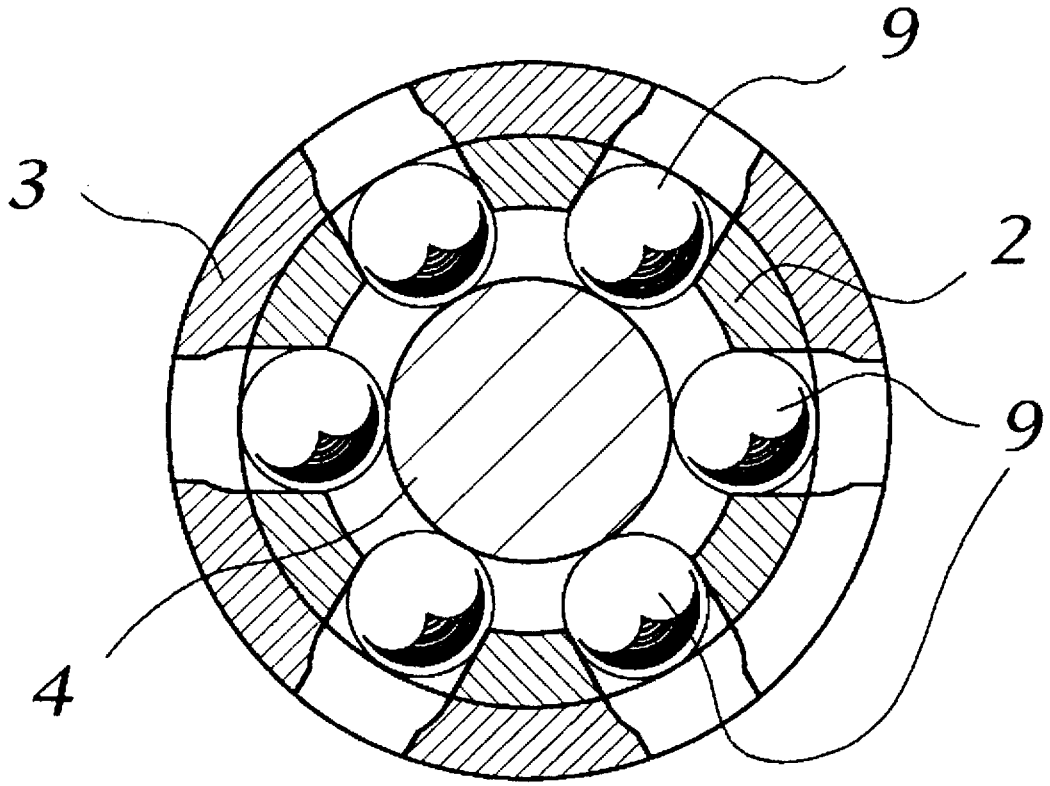
FIG. 4 is a cross sectional view along line IV—IV in FIG. 2.

Referring in detail to the drawings and with particular reference to FIGS. 1–4, a lock-up device 1 is shown for locking together a pair of sleeves. This lock-up device has an inner lock sleeve 2 slidably received within an outer lock sleeve 3. A cam member 4 is disposed within the inner lock sleeve 2. As will be shown later, the cam member 4 can be disposed on the outer surface of the outer lock sleeve 3. The cam member 4 is provided with a cam surface 26 for forcing locking balls 9 into the locking position as shown in FIGS. 1 and 3, and for receiving the locking balls 9 in an unlocking position as shown in FIGS. 2 and 4.

The inner lock sleeve 2 is provided with a ball contact surface 24. The outer lock sleeve 3 is provided with a ball contact surface 25. Several lock balls 9 are provided around the periphery of the lock-up device. The lock balls 9 are movable between the locking position and the unlocking position along ball contact surfaces 24 and 25, as shown in FIGS. 1–4. The inner and outer lock sleeve ball contact surfaces 24 and 25 are concave and have a radius of curvature substantially equal to the curvature of the lock balls 9. In other words, the inner and outer lock sleeve ball contact surfaces 24 and 25 are cupped so as to achieve maximum contact with the balls 9. Described in yet another way, the ball contact surfaces 24, 25 are formed of a three dimensional section of an inner-spherical surface. The achievement of increased ball contact surface area allows the lock-up device to withstand much higher loads than conventional ball lock-up devices. The increased contact surface area distributes the load so that the lock ball and inner and outer lock sleeve contact surfaces are less likely to deform. Through experimentation, it has been determined that an optimal surface contact area of about 34% is obtainable, as indicated by angles a in FIG. 1, while the angle b should be minimized to enhance unlocking.

The outer lock sleeve 3 is provide with leaf springs 13 for biasing the lock balls 9 from the locked position when the cam member 4 is moved to the unlocking position as shown in FIG. 2. The leaf springs 13 can be replaced with other biasing means, examples of which would be any other type of spring, air pressure or a mechanical linkage movable with the cam member 4 to bias the lock balls 9 from the locking position when the cam member 3 is moved to the unlocking position.

Figure 5:
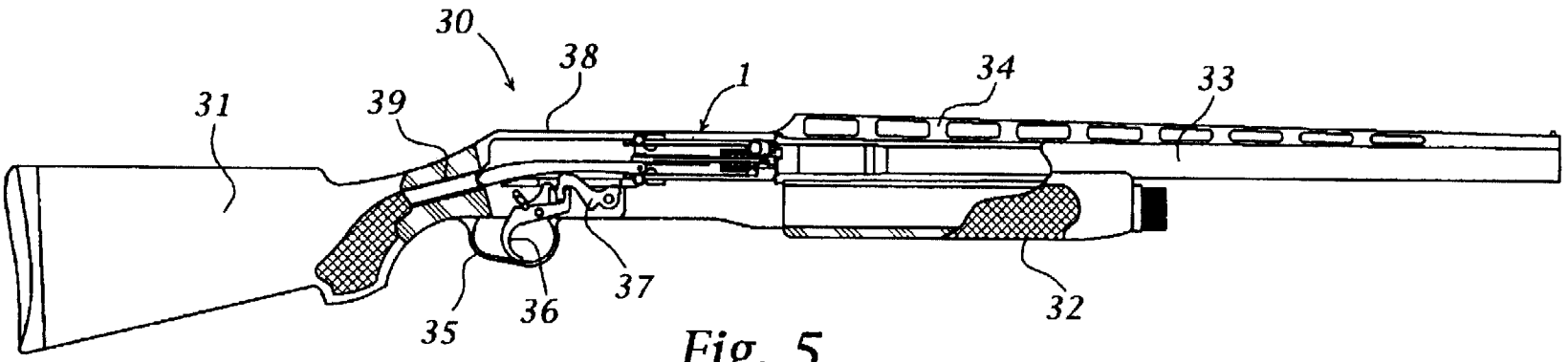
FIG. 5 is a side view of a shotgun having a lock-up device according to a first embodiment of the present invention.

The operation of the preferred embodiment of the lock-up device will now be described with reference to FIGS. 5 and 6. In FIG. 5, a firearm 30 is shown, having a lock-up device 1. The firearm includes a buttstock 31 which is attached to a rear end of a receiver portion 38. A forestock 32 is attached at a forward end of the receiver portion 38. A barrel 33 is provided above the forestock 32 and is connected with the forward end of the receiver portion 38. A site rib 34 is disposed along the length of the barrel 33.

A trigger guard 35 is below the receiver portion 38 and is disposed around a trigger 36. A hammer 37 is in connection with the trigger 36 and is located within the receiver portion 38. The lock-up device 1 is also disposed within the receiver portion 38.

Figure 6:
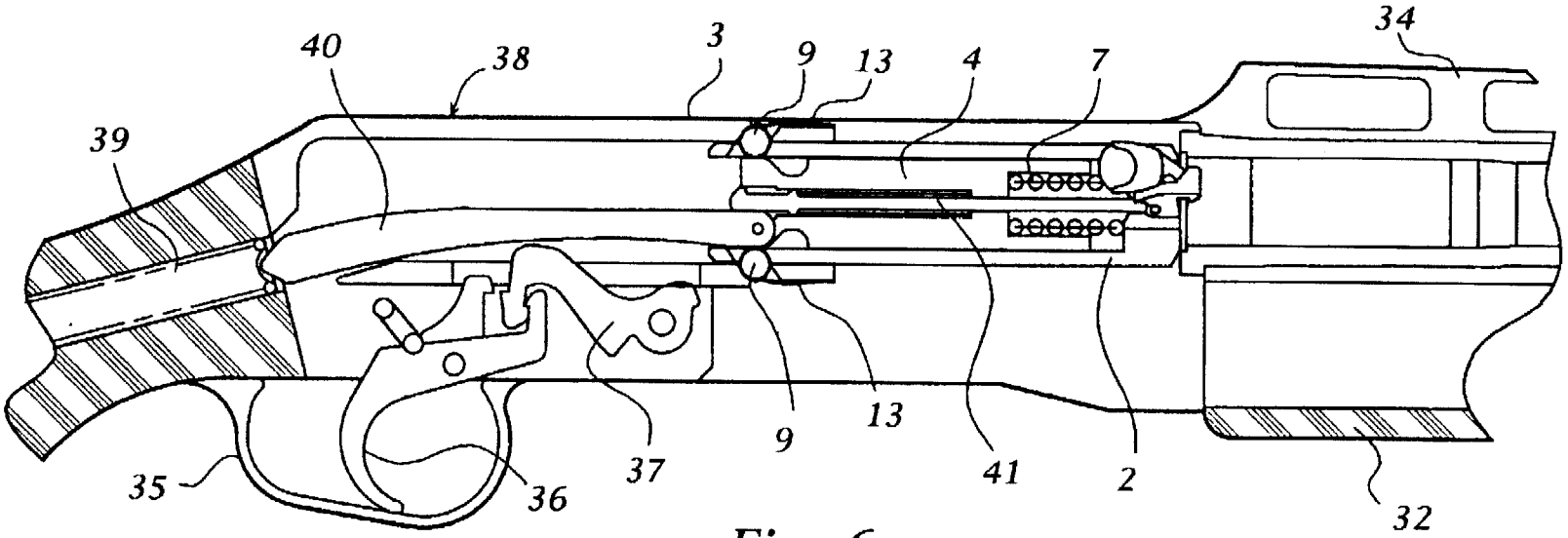
FIG. 6 is an enlarged sectional side view of the lock-up device of FIG. 5.
Figures 7A, 7B, 7C, 7D:
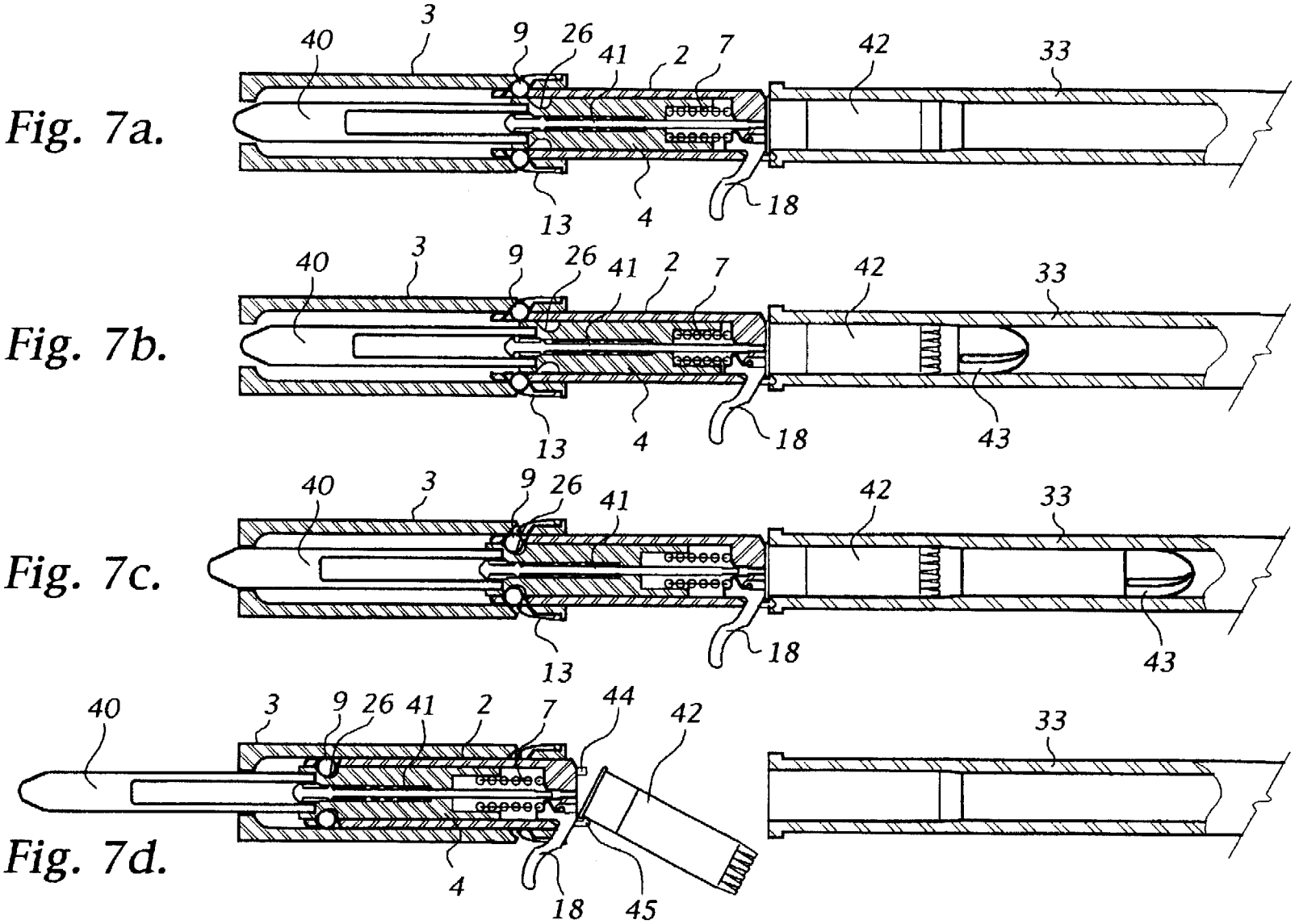
FIGS. 7*a*, 7*b*, 7*c* and 7*d* illustrate each phase of operation of the lock-up device as embodied in the shotgun of FIG. 5.

Reference is now made to FIG. 6, which shows the operating components of the present invention disposed within the firearm 30. The lock-up device 1 is shown in the receiver portion 38 of the firearm. The lock-up device 1 includes inner lock sleeve 2 disposed within the outer lock sleeve 3. A cam member 4 is disposed within the inner lock sleeve 2. Lock balls 9 are disposable in a locking position, as is shown in FIG. 6, between the inner lock sleeve 2 and the outer lock sleeve 3. The lock balls 9 are also disposable in an unlocking position within the cam grooves 26, as will be shown with respect to FIGS. 7*c* and 7*d*.

A recoil rod 40 is pivotally attached on one end to the cam member 4. The other end of the recoil rod 40 is disposed so as to press against recoil spring 39 which acts to bias the recoil rod 40 against rearward movement. A firing pin 41 is disposed within the cam member 4.

The operation of the locking device within the firearm will now be discussed with reference to FIGS. 6 and 7(*a*)–7(*d*). In operation, the trigger 36 is pulled backward, releasing the hammer 37. The hammer 37 springs forward, striking the firing pin 41, causing ammunition cartridge 42 to erupt, thereby discharging projectile 43 along the length of the barrel 33, as shown in FIG. 7(*b*). Also shown in FIG. 7(*b*), the barrel 33 and the inner lock sleeve 2, which are subject to a recoil force which is equal and opposite to the force exerted on the projectile 43, causes the barrel 33 and inner lock sleeve 2 to move rearward relative to the cam member 4. This relative movement causes the cam spring 7 to contract at first, thus storing inertia energy, as shown in FIG. 7(*b*).

With reference to FIG. 7(*c*), the cam spring 7 subsequently expands, forcing the cam member 4 to slide relative to the inner and outer lock sleeves 2 and 3, and allowing the lock balls 9 under the force of spring member 13, to disengage from the locking position. As the lock balls 9 are biased by the leaf spring 13 into the cam groove 26, the inner lock sleeve 2 is free to move relative to the outer lock sleeve 3, as shown in FIG. 7(*d*).

In FIG. 7(*d*), the lock-up device is shown in its cycling phase. During this phase, the cam member 4 and inner lock sleeve 2 are locked together by lock balls 9. The recoil rod 40 presses against recoil spring 39, causing the recoil spring 39 to contract. When the inner lock sleeve 2 reaches a furthest rearward position, the spent ammunition cartridge 42 is ejected by the ejector and extractor members 44 and 45, respectively, through an opening in the receiver portion 38 of the firearm 30, by methods which are known. The new ammunition cartridge is then reloaded, by methods which are known, and the recoil spring 39 forces recoil rod 40 to move the cam member 4 and inner lock sleeve 2 forwardly. When the inner lock sleeve has reached its original position, the recoil spring 39 which is still under load, biases the cam 4 to move forward, thereby forcing the ball up the cam groove 26 and into the locking position between inner lock sleeve 2 and outer lock sleeve 3 as shown in FIG. 7(*a*).

It is noted that a manual cocking handle 18 is in connection with the cam member 4, so that the ammunition cartridge 42 can be inserted or removed without requiring the firearm to be discharged.

Figure 8B:
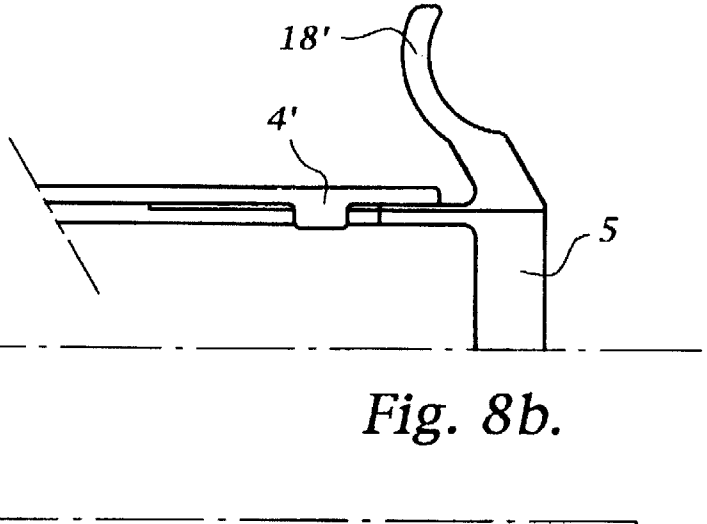
FIGS. 8*a* and 8*b* are side views of a second embodiment of the present invention with the lock-up device shown in the locked position.
Figure 8C:
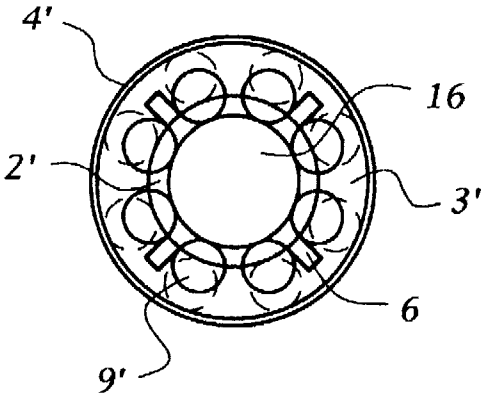
FIG. 8*c* is a cross sectional view of the second embodiment showing the lock balls in the locked position.

The operation of a second embodiment of the present invention will now be described with reference to FIGS. 8–12. In this embodiment, the lock-up device 1' has a cam member 4' disposed radially outward of the inner lock sleeve 2'. In FIG. 8, the lock-up device 1' is shown in the locked position with the inner lock sleeve 2' and the outer lock sleeve 3' locked together by lock balls 9'. The lock balls 9' are disposed between the concave ball contact surfaces 24' and 25' of inner and outer lock sleeves 2' and 3', respectively. Cam member 4' is disposed radially outward of the inner and outer lock sleeves 2' and 3', and operates to maintain the lock balls 9' in the locked position.

A seal 12 is disposed between a front portion of the cam 4' and the inner lock sleeve 2'. A bolt 5 is slidably disposed radially inward of a rear portion of the cam member 4'. A bolt/outer lock sleeve retainer 11 is provided for retaining the bolt 5 and outer lock sleeve 3' in contact. A seal/headspace adjusting shim 10 is provided between a forward end of the bolt 5 and the outer lock sleeve 3' at a location radially inward of the cam member 4'.

A ball spreader 13' is located at the forward end of the inner lock sleeve 2' and is located radially inward of the outer lock sleeve 3' while the lock-up device 1' is in the locked position. The ball spreader 13' in the embodiment shown is a leaf spring, however any biasing means may be replaced for the leaf spring. A compression spring 14 is provided between the ball spreader 13' and a spring stop member 19. A cam spring 7' and a cam spring actuator rod 6 is provided between the spring stop member 19 and the cam member 4'. The spring stop member 19 is disposed within the bolt 5 and is provided with a seal 15 between a radial portion of the spring stop member 19 and the bolt 5. The spring stop member 19 is fixed to the shaft member 16. The shaft member 16 is for example the barrel of the firearm, however, it may be a magazine tube or other shaft.

Figure 8A:
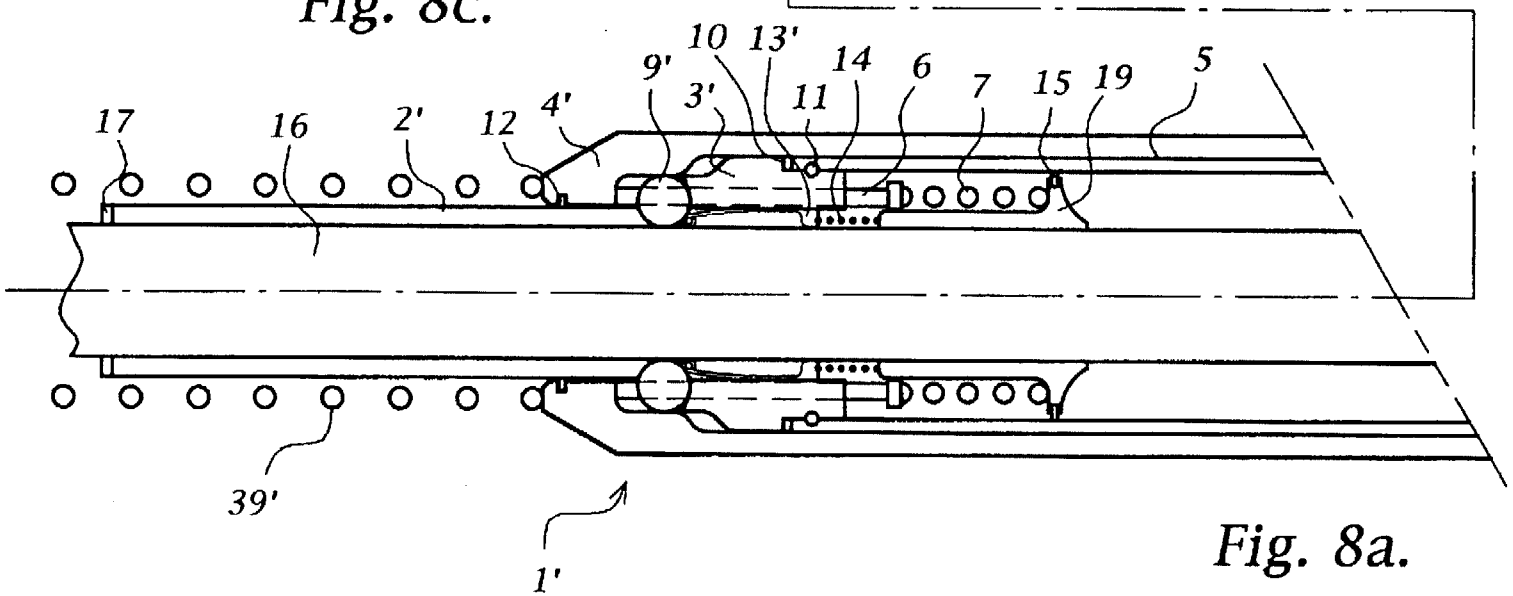
Figure 9B:
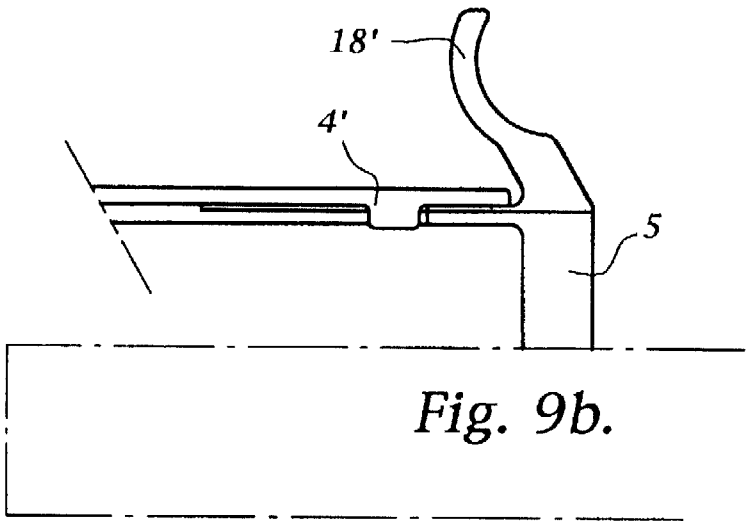
FIGS. 9*a* and 9*b* are side views of the second embodiment of FIGS. 8*a* and 8*b* with the lock-up device under recoil.
Figure 9C:
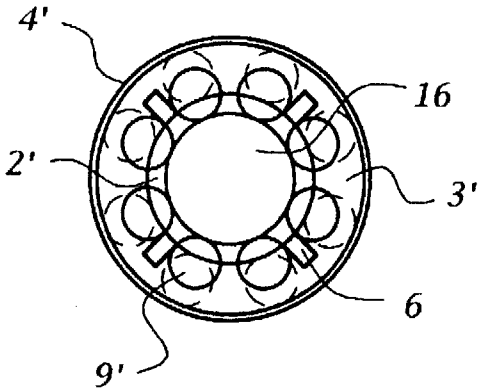
FIG. 9*c* is a cross sectional view showing the lock balls of the second embodiment in the recoil position.
Figure 9A:
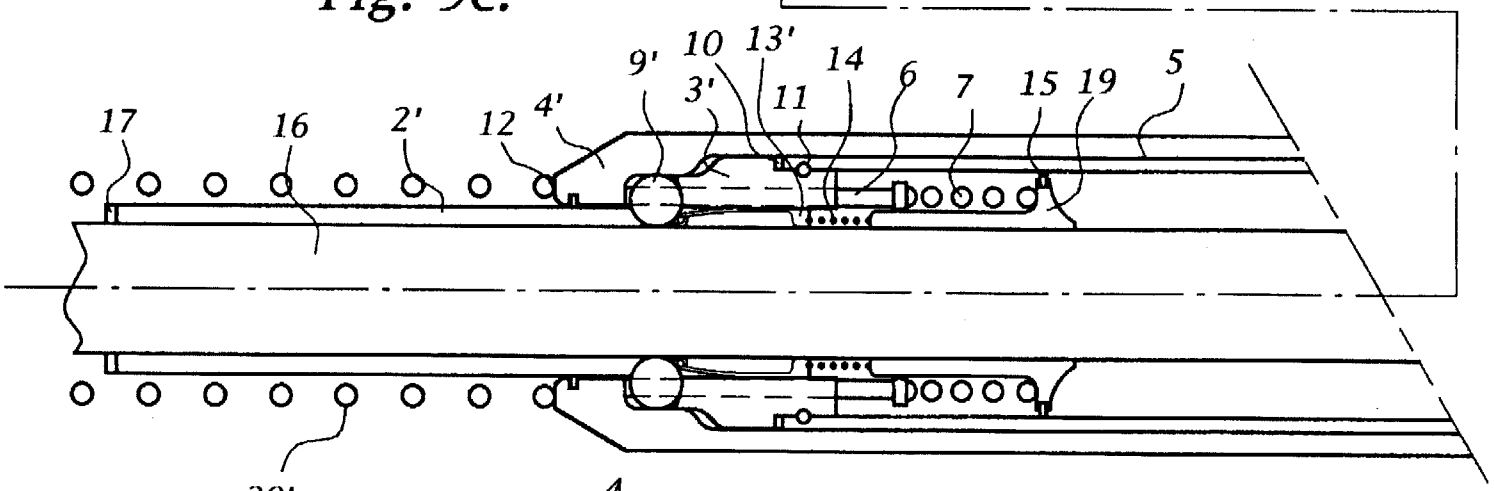
Figure 10B:
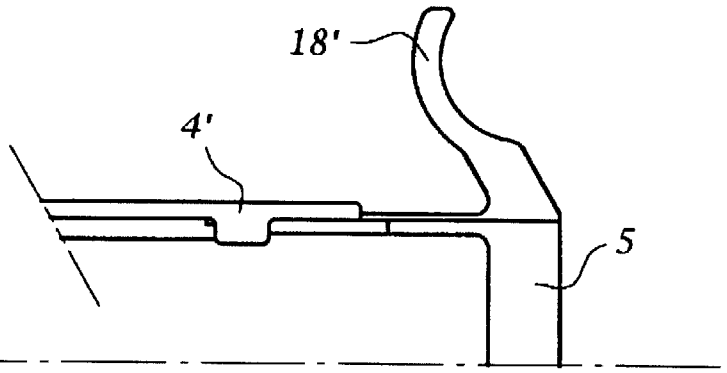
FIGS. 10*a* and 10*b* are side views of the second embodiment of FIGS. 8*a* and 8*b* with the lock-up device in an unlocking position.
Figure 10C:
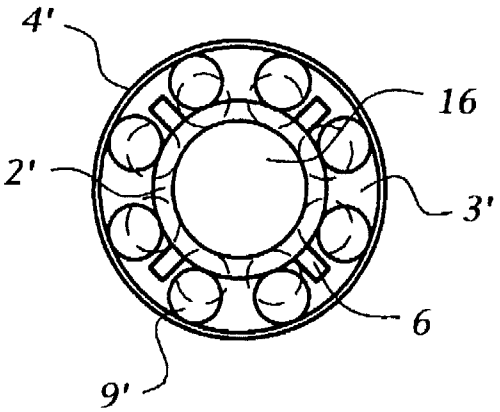
FIG. 10*c* is a cross sectional view showing the lock balls of the second embodiment in an unlocking position.
Figure 10A:
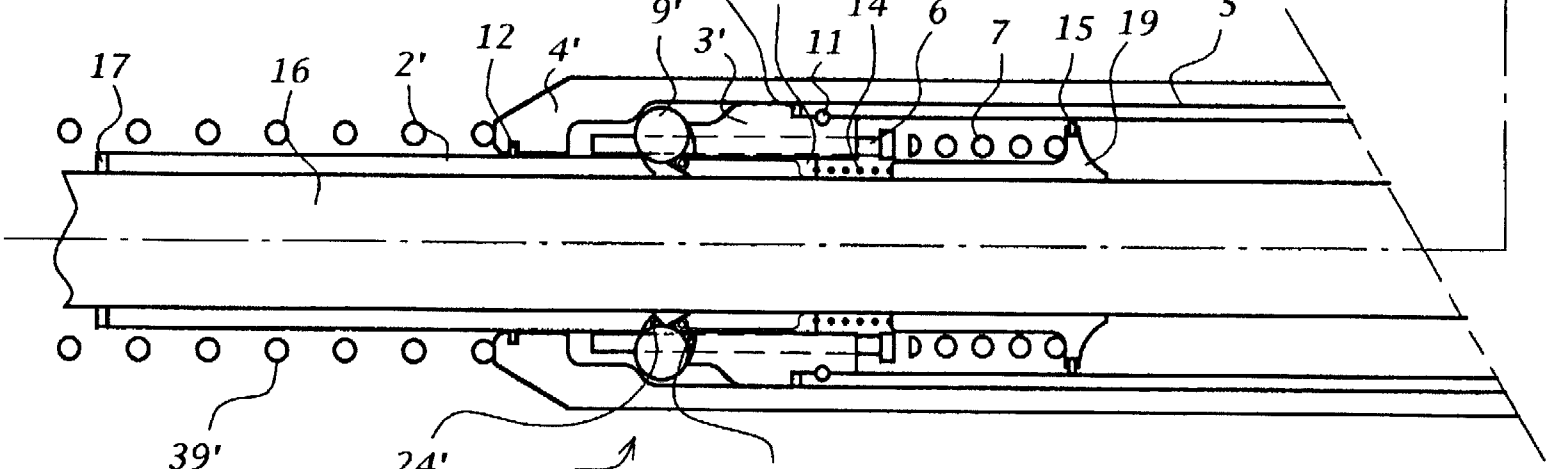
Figure 11B:
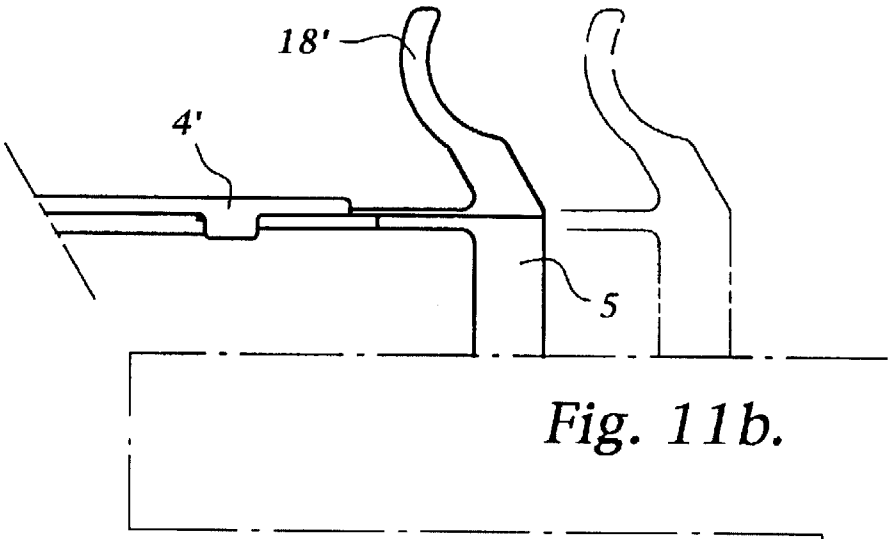
FIGS. 11*a* and 11*b* are side views of the second embodiment of FIGS. 8*a* and 8*b* with the lock-up device cycling.
Figure 11C:
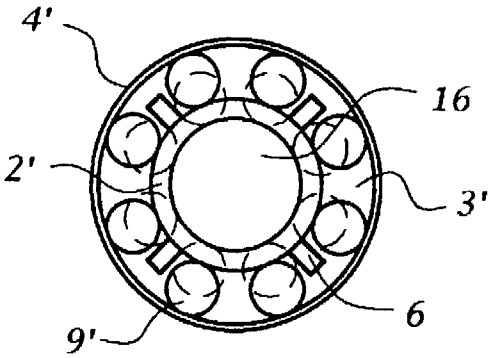
FIG. 11*c* is a cross sectional view showing the lock balls of the second embodiment in an unlocked position.
Figure 11A:
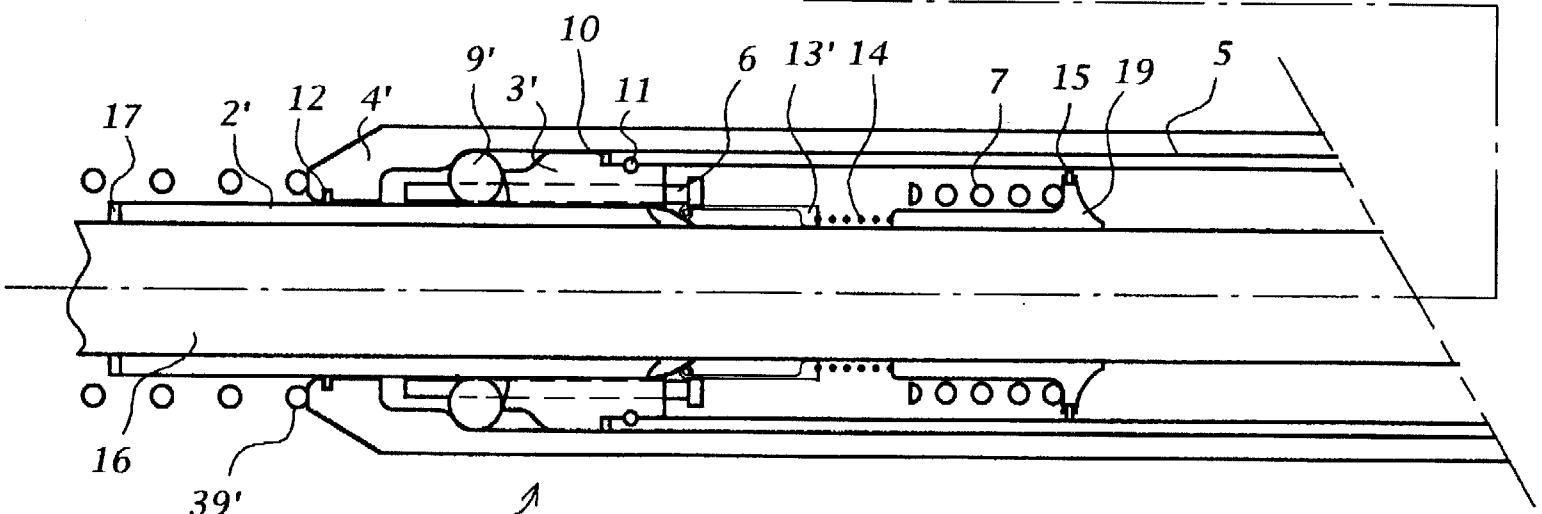

In operation, when inertia is delivered to inner lock sleeve 2', the outer lock sleeve 3' is forced rearward which in turn, delivers a rearward force to the inner lock sleeve 2' through lock balls 9'. As the outer lock sleeve 3' is forced rearward, the cam spring 7' is compressed through connection to the cam member 4' by the cam spring actuator rod 6. While the cam spring 7' is being compressed, the cam member 4' is allowed to move forward relative to the inner and outer lock sleeves 2' and 3', as shown in FIG. 9*a*. The cam spring 7' then expands, forcing the cam member 4' to move rearward relative to the inner lock sleeve 2' and outer lock sleeve 3'. As the inner lock sleeve 2' and the outer lock sleeve 3' reach the position as shown in FIG. 10*a*, the lock balls 9' are biased out of the locking position by the ball spreading means 13'. As the lock balls 9' are disengaged, the outer lock sleeve 3' is forced to move rearward relative to the inner lock sleeve 2' by the inertia force stored in the cam spring 7', which is compressed. As is shown in FIG. 11*a*, the outer lock sleeve 3' has slid rearward, thereby allowing the firearm ammunition to be cycled. A recoil spring 39' biases the cam member 4' forward relative to the inner lock sleeve 2' and back into the locked position as shown in FIG. 8*a*.

Figures 12A, 12B, 12C:
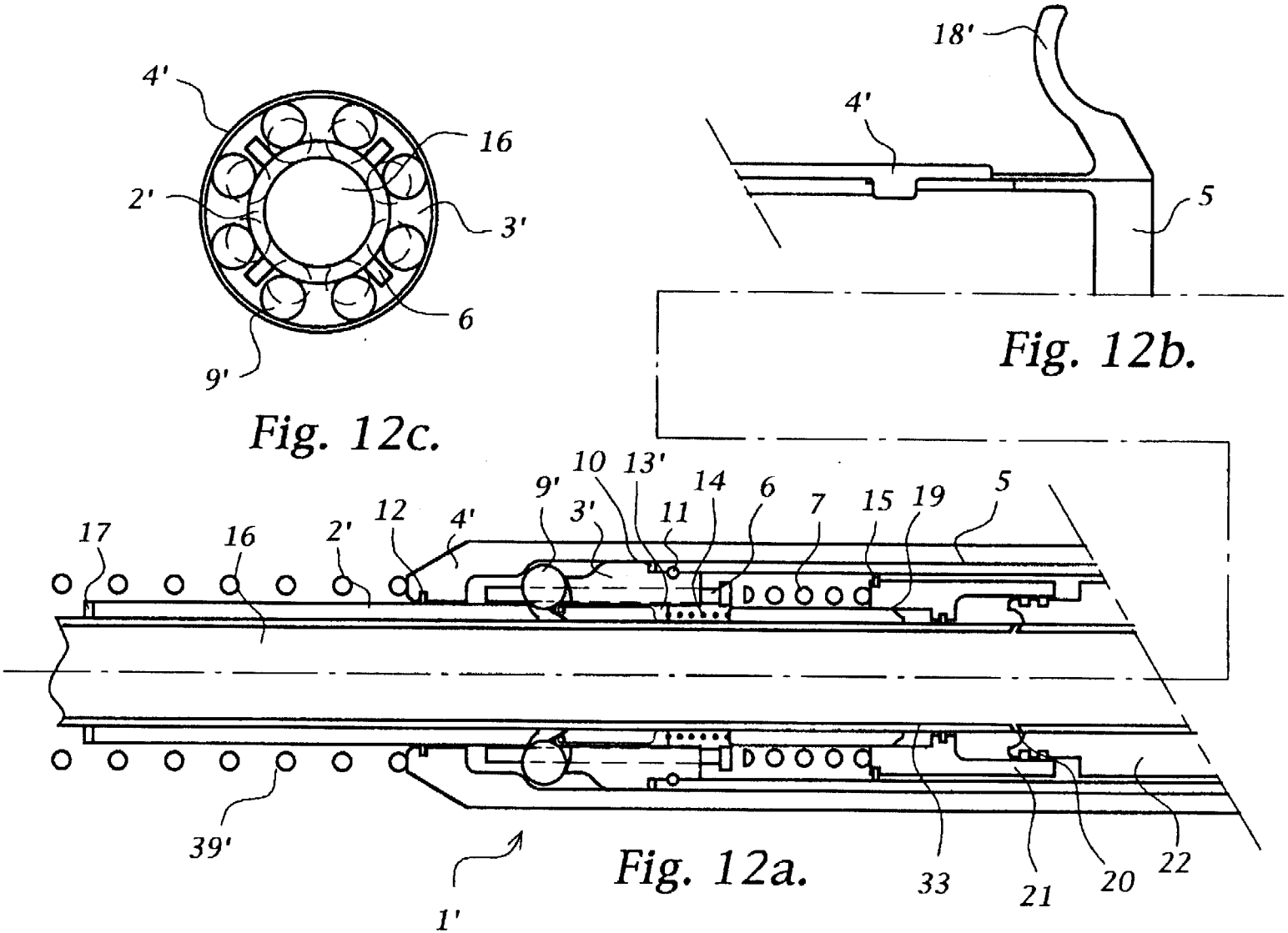
FIGS. 12*a* and 12*b* are sectional side views of a lock-up device of the second embodiment disposed in a firearm with a gas assist.
FIG. 12*c* is a cross sectional view showing the lock balls of the second embodiment in an unlocked position.

A modified form of the second embodiment of the present invention is shown in FIGS. 12*a–c*. The lock-up device 1' is the same as in the previous embodiment, however a gas assist device has been added to assist the lock-up device in cycling. Where less powerful ammunition cartridges are used, it may be necessary to add the gas assisted device to insure that the firearm completely cycles.

In FIG. 12, the gas assist device includes a gas port 20 on the inner surface of the barrel member 33. A gas block 22 is disposed radially outward and forward of the gas port 20. A gas piston 21 engages the gas block 22 and connects it to the cam member 4'.

In operation, when an ammunition cartridge is fired, the projectile is discharged down the barrel 33, due to the explosive force of the ammunition cartridge. Expanding gas in the barrel enters the gas port 20, thus creating a forward pressure force on gas block 22, which in turn causes the gas piston 21 to move rearward and exert a compression force on cam spring 7'. In the case of smaller ammunition cartridges, the additional compression force applied to cam spring 7' is sufficient to assist the lock-up device 1' in cycling the firearm. The complete cycle of this embodiment is the same as that of the embodiment of FIGS. 8–11, therefore a complete description of the operation is unnecessary.

Figure 13:
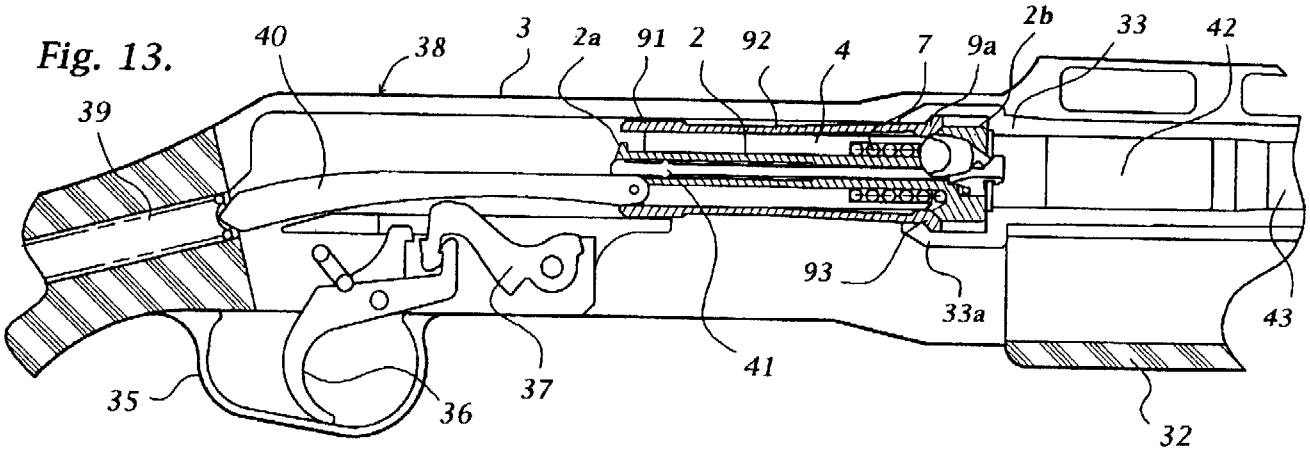
FIG. 13 is a side view of a shotgun having a spring-finger lock-up device according to a third embodiment of the present invention.

FIG. 13 is a side view of a shotgun having a spring-finger-type lock-up device 9*a* according to a third embodiment of the present invention. In FIG. 13, the lock-up device includes an inner lock sleeve 2 which is provided with a projection portion 2*a* and a spring-finger abutting portion 2*b*. An outer lock sleeve 3 is disposed radially outwardly from the inner lock sleeve 2. This outer lock sleeve 3 includes a barrel extension 33*a*. A spring-finger-type lock-up device 9*a* is disposed between the inner lock sleeve 2 and the outer lock sleeve 3. The spring-finger-type lock-up device includes a sleeve portion 91 and a plurality of spring-finger portions 92. A locking element 93 is disposed at the end of each spring-finger 92. In a locked position, the locking element 93 is disposed between the outer lock sleeve 3 and the inner lock sleeve spring-finger abutting portion 2*b*. A cam member 4 is provided between the inner lock sleeve 2 and the outer lock sleeve 3, and when at rest, maintains the spring-finger lock element 93 in a locked position between the outer lock sleeve 3 and the inner lock sleeve spring-finger abutting portion 2*b*. A cam spring 7 is disposed between the cam member 4 and the inner lock sleeve 2. A recoil rod 40 is attached at one end to the cam member 4 and abuts against a recoil spring 39 at a second end thereof. Finally, a firing pin 41 is disposed within the inner lock sleeve 2.

In operation, the trigger 36 is pulled backward, releasing the hammer 37. The hammer 37 springs forward, striking the firing pin 41 causing ammunition cartridge 42 to erupt, thereby discharging projectile 43 along the length of the barrel 33. The barrel 33 and the inner lock sleeve 2 are subject to a recoil force which is equal and opposite to the force exerted on the projectile 43. This force causes the barrel 33 and inner lock sleeve 2 to move rearward relative to the weighted cam member 4. This relative movement causes the cam spring 7 to be compressed at first, thus storing inertia energy.

The cam spring 7 subsequently expands, forcing the cam member 4 to slide relative to the inner and outer lock sleeves 2 and 3, and allowing the locking element 93 of the spring-finger-type locking device **9*a*, under the force of the spring-finger portion 92, to disengage from the locking position. As the locking element 93 is biased by the spring-finger portion 92, the inner lock sleeve 2 is free to move relative to the outer lock sleeve 3**.

During the cycling phase, the cam member 4 and inner lock sleeve 2 are locked together by the projecting portion **2*a*. The recoil rod 40 presses against recoil spring 39, causing the recoil spring to compress. When the inner lock sleeve 2 reaches a furthest rearward position, the spent ammunition cartridge 42 is ejected by the ejector and extractor members 44 and 45, respectively, through an opening in the receiver portion 38 of the firearm 30 by methods which are known. The new ammunition cartridge is then reloaded, by means which are known, and the recoil spring 39 forces recoil rod 40 to move the cam member 4 and inner lock sleeve 2 to move forward. When the inner lock sleeve has reached its original position, the recoil spring 39 which is still under load, biases the cam 4 to move forward, thereby forcing the locking element 93 of the spring-finger-type locking device 9*a* into the locking position between the inner lock sleeve 2 and the outer lock sleeve 3**.

Figure 14A:
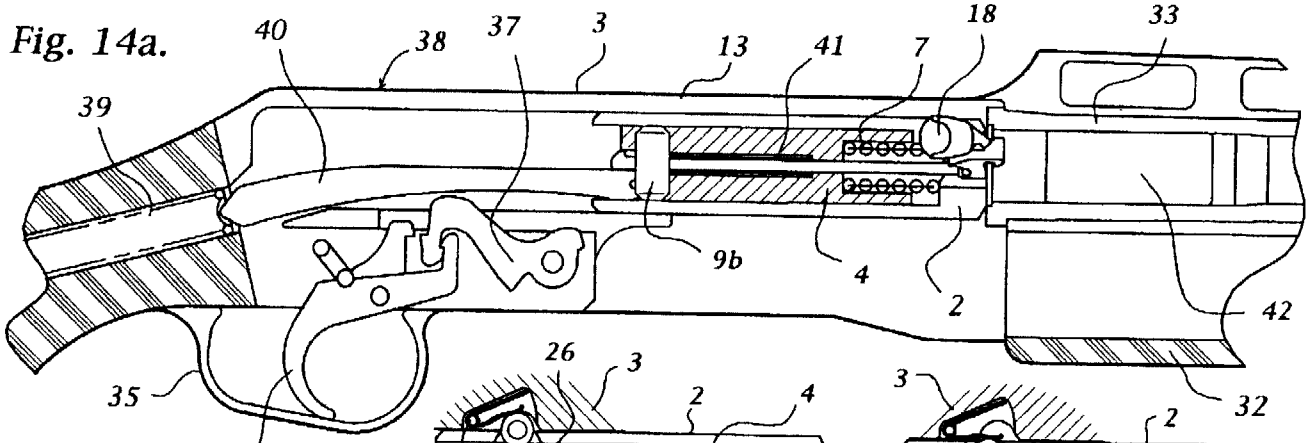
FIG. 14*a* is a side view of a firearm having a roller-type lock-up device according to a fourth embodiment of the present invention.
Figure 14C:
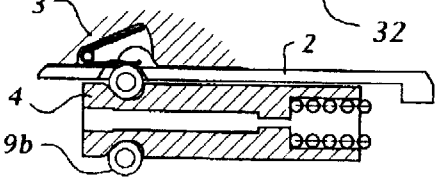
FIG. 14*c* is a partial top view of the cam member and rollers of FIG. 14*a* in an unlocked position.
Figure 14B:
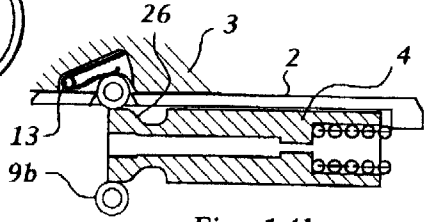
FIG. 14*b* is a partial top view of the cam member and rollers of FIG. 14*a* in a locked position.

FIG. **14*a* is a side view of a shotgun having a roller-type lock-up device according to a fourth embodiment of the present invention. In this embodiment, the lock-up device includes at least two rollers 9*b* which are received in recesses provided in the inner and outer lock sleeves 2, 3. The remaining elements of the embodiment of FIGS. 14*a*–14*c* are essentially the same as those disclosed in FIGS. 5–7** and discussed earlier.

The operation of the locking device disclosed in FIG. **14*a* will now be discussed with reference thereto. In operation, the trigger 36 is pulled backward, releasing the hammer 37. The hammer 37 springs forward, striking the firing pin 41, causing ammunition 42 to erupt, thereby discharging projectile 43 along the length of the barrel 33. The barrel 33 and the inner lock sleeve 2, which are subject to a recoil force which is equal and opposite to the force exerted on the projectile 43. This force causes the barrel 33 and inner lock sleeve 2 to move rearward relative to the cam member 4. This relative movement causes the cam spring 7** to contract at first, thus storing inertia energy.

The cam spring 7 subsequently expands, forcing the cam member 4 to slide relative to the inner and outer lock sleeves 2 and 3, and allowing the rollers **9*b* under the force of a spring member 13, to disengage from the locking position. As the rollers 9*b* are biased by the leaf spring 13 into the cam groove 26 of the cam member 4, the inner lock sleeve 2 is free to move relative to the outer lock sleeve 3**.

During the cycling phase, the cam member 4 and inner lock sleeve 2 are locked together by rollers **9*b*. The recoil rod 40 presses against recoil spring 39, causing the recoil spring 39 to contract. When the inner lock sleeve 2 reaches a furthest rearward position, the spent ammunition cartridge 42 is ejected by the ejector and extractor members 44 and 45, respectively, through an opening in the receiver portion 38 of the firearm 30, by methods which are known. The new ammunition cartridge is then reloaded, by methods which are known. The recoil spring 39 then forces recoil rod 40 to move the cam member 4 and inner lock sleeve 2 to the forward position. When the inner lock sleeve 2 has reached its original position, the recoil spring 39 which is still under load, biases the cam 4 to move forward, thereby forcing the roller 9*b* up the surface of groove 26 and into the locking position between inner lock sleeve 2 and outer lock sleeve 3**.

Figure 15:
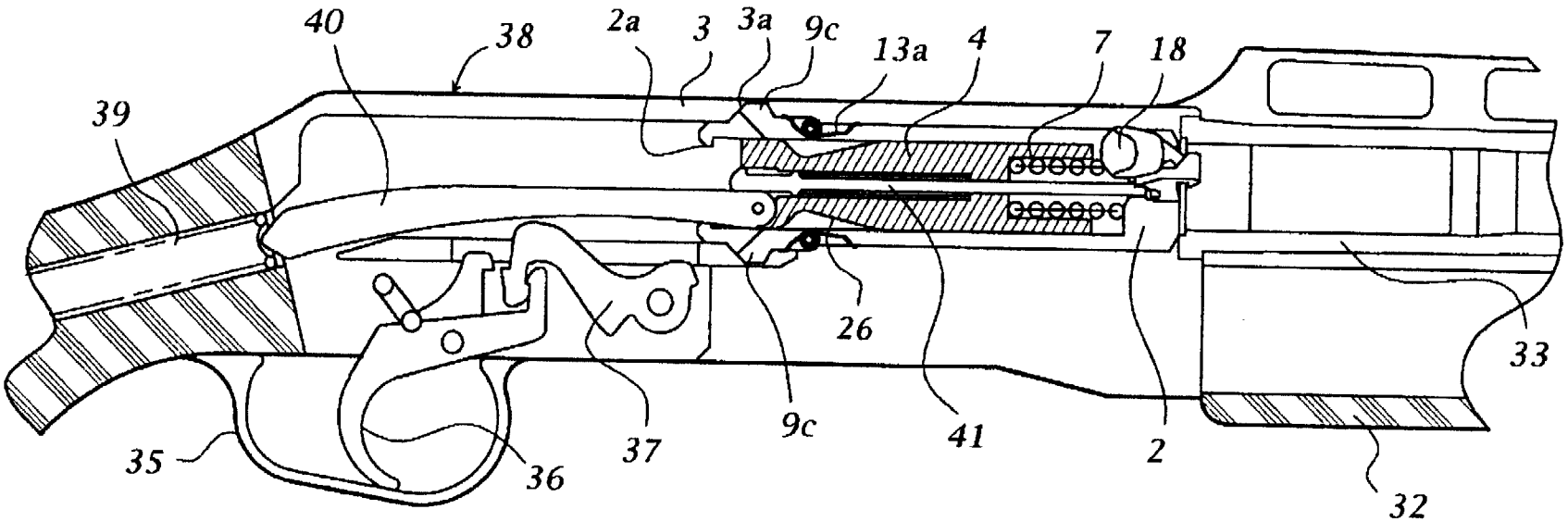
FIG. 15 is a side view of a firearm having a toggle lug hook-type lock-up device according to a fifth embodiment of the present invention.

FIG. 15 is a side view of a shotgun having a toggle lug-type lock-up device according to a fifth embodiment of the present invention. In the embodiment of FIG. 15, the lock-up device includes a plurality of toggle lugs **9*c* pivotably attached to the inner lock sleeve 2. The outer lock sleeve 3 is provided with a plurality of recesses 3*a* for receiving a bent portion of the toggle lug. The cam member 4 is also provided with a plurality of cam surfaces for receiving the toggle lug therein. The inner lock sleeve 2 is provided with bent projecting portions 2*a* which extend radially inward. Finally, the toggle lugs 9*c* are provided with a biasing spring 13*a* which bias the toggle lugs 9*c*** radially inward.

The operation of the locking device according to the fifth embodiment will now be discussed with reference to FIG. 15. In operation, the trigger 36 is pulled backward, releasing the hammer 37. The hammer 37 springs forward, striking the firing pin 41, causing ammunition cartridge 42 to erupt, thereby discharging projectile 43 along the length of the barrel 33. The barrel 33 and the inner lock sleeve 2 are subject to a recoil force which is equal and opposite to the force exerted on the projectile 43. This force causes the barrel 33 and inner lock sleeve 2 to move rearward relative to the cam member 4. This relative movement causes the cam spring 7 to contract at first, thus storing inertia energy. The cam spring 7 subsequently expands, forcing the cam member 4 to slide relative to the inner and outer lock sleeves 2 and 3, and allowing the toggle lugs **9*c* under the force of the spring 13*a* to disengage from the locking position. As the toggle lugs 9*c* are biased by the spring 13*a* into the cam groove 26, the inner lock sleeve 2 is free to move relative to the outer lock sleeve 3**.

During the cycling phase, the cam member 4 and inner lock sleeve 2 are locked together by the radially inward projecting portion **2*a* of the inner lock sleeve 2. The recoil rod 40 presses against recoil spring 39, causing the recoil spring 39 to contract. When the inner lock sleeve 2 reaches a furthest rearward position, the spent ammunition cartridge 42 is ejected by the ejector and extractor members 44 and 45, respectively, through an opening in the receiver portion 38 of the firearm 30, by methods which are known. The new ammunition cartridge is then reloaded, by methods which are known, and the recoil spring 39 forces recoil rod 40 to move the cam member 4 and inner lock sleeve 2 to a forward position. When the inner lock sleeve 2 has reached its original position, the recoil spring 39 which is still under load, biases the cam member 4 to move forward, thereby forcing the toggle lugs 9*c* into the locking position in the recesses of the outer lock sleeve 3**.

Figure 16A:
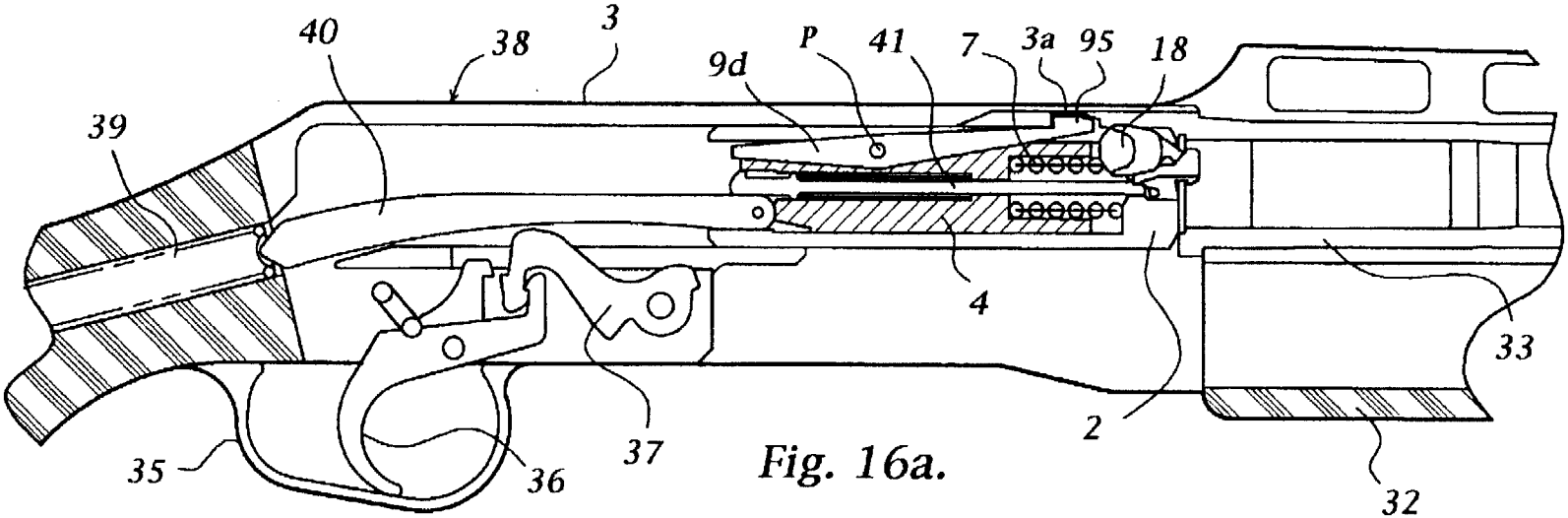
FIG. 16*a* is a side view of a firearm having a lever-type lock-up device according to a sixth embodiment of the present invention.

FIG. 16*a* is a side view of a firearm having a lever-type lock-up device according to a sixth embodiment of the present invention. In this embodiment, the outer lock sleeve is provided with a recess 3*a*. The recess 3*a* receives a hook portion 95 of a lever type lock-up device 9*d*. The lever-type lock-up device 9*d* is pivotably attached to the inner lock sleeve 2 at pin P. The lever-type lock-up device 9*d* has substantially a U-shaped configuration with two arm members interconnected by a bottom cross member 96 which engages with the surface of cam groove 26 of cam member 4.

Figure 16B:
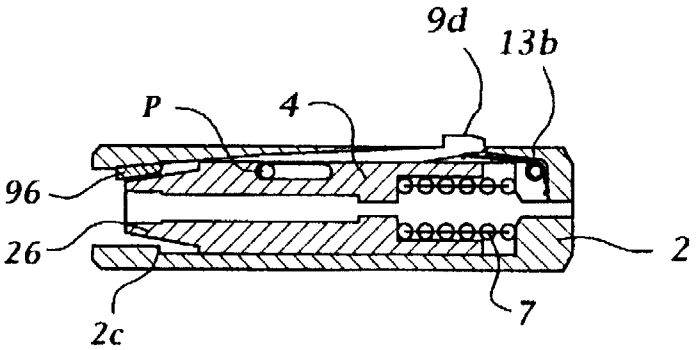
FIG. 16*b* is a cutaway view of the lever-type lock-up device of FIG. 16*a;*

In FIG. 16*b*, it should be appreciated that the arm members of the lock-up device 9*d* would extend from the forward end to the bottom cross member 96; however, the near arm member has been cut away to show the underlying cam member 4. This U-shaped lock-up device 9*d* would surround three sides of cam member 4 when in the FIG. 16*a* position.

Figure 16C:
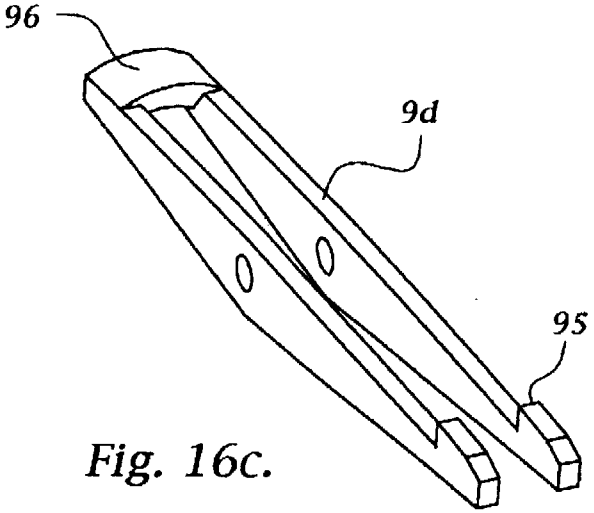
FIG. 16*c* is a perspective view of the lever-type lock-up device of FIG. 16*a;*

The operation of the locking device according to the sixth embodiment will now be discussed with reference to FIG. 16. In operation, the trigger 36 is pulled backward, releasing the hammer 37. The hammer 37 springs forward, striking the firing pin 41, causing ammunition cartridge 42 to erupt, thereby discharging projectile 43 along the length of the barrel 33. The barrel 33 and the inner lock sleeve 2, which are subject to a recoil force which is equal and opposite to the force exerted on the projectile 43, causes the barrel 33 and inner lock sleeve 2 to move rearward relative to the cam member 4. This relative movement causes the cam spring 7 to compress at first, thus storing inertia energy. The cam spring 7 subsequently decompresses, forcing the cam member 4 to slide rearward relative to the inner and outer lock sleeves 2 and 3. Sliding of cam member 4 forces the lever-type lock-up device 9*d* to pivot about the pin P as the cam surface 26 engages the bottom cross member 96 of the lever-type lock-up device 9*d*. Accordingly, the forward end of the lever-type lock-up device 9*d* disengages from the recess 3*a* of the outer lock sleeve. As the lever-type lock-up device 9*d* is pivoted, the inner lock sleeve 2 is free to move relative to the outer lock sleeve 3.

During the cycling phase, the cam member 4 and inner lock sleeve 2 are locked together by the rear lip 2*c* of the inner lock sleeve 2. This lip 2*c* mates with the radial shoulder of cam member 4. The recoil rod 40 presses against recoil spring 39, causing the recoil spring 39 to contract. When the inner lock sleeve 2 reaches a furthest rearward position, the spent ammunition cartridge 42 is ejected by the ejector and extractor members 44 and 45, respectively, through an opening in the receiver portion 38 of the firearm 30 by methods which are known. The new ammunition cartridge is then reloaded, by means which are known, and the recoil spring 39 forces the recoil rod 40 to move the cam member 4 and inner lock sleeve 2 forward. When the inner lock sleeve 2 has reached its original position, the recoil spring 39 which is still under a load, biases the cam 4 to move forward, thereby allowing the lever-type lock-up device 9*d* which is biased under a spring force 13*b* to move into the recess 3*a* of the outer lock sleeve 3.

Figure 17:
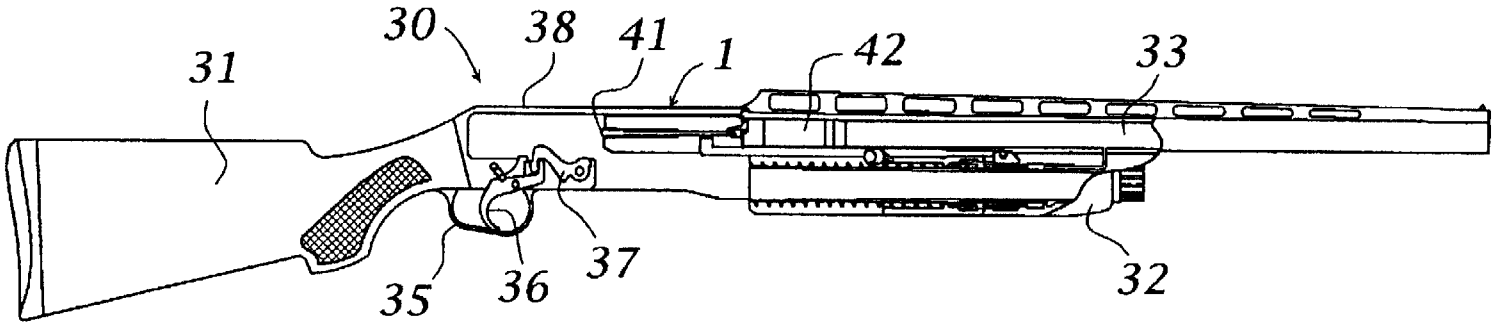
FIG. 17 is a side view of a firearm equipped with a radial ball lock-up device disposed in the forestock of the firearm.
Figure 18A:
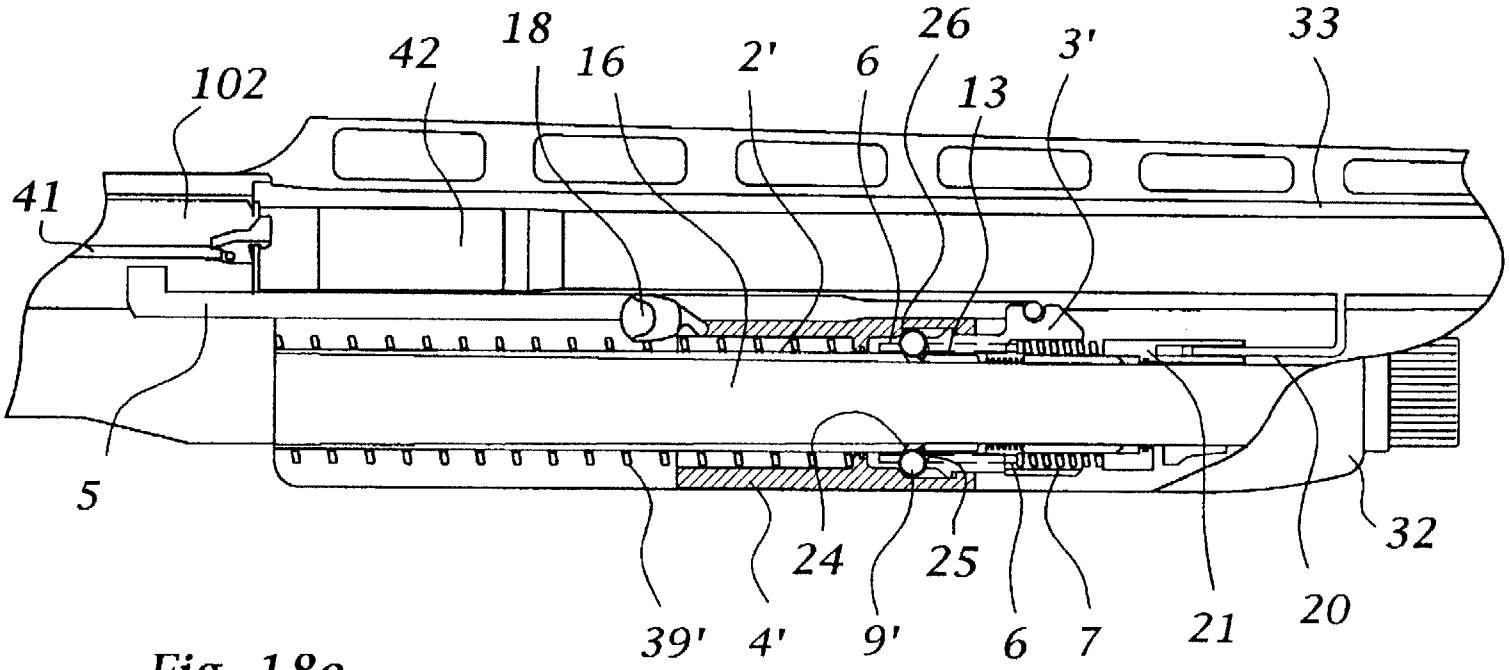
FIG. 18*a* is a side view of a shotgun having a radial ball lock-up device according to the second embodiment of the present invention disposed in the forestock of the firearm.
Figure 18B:
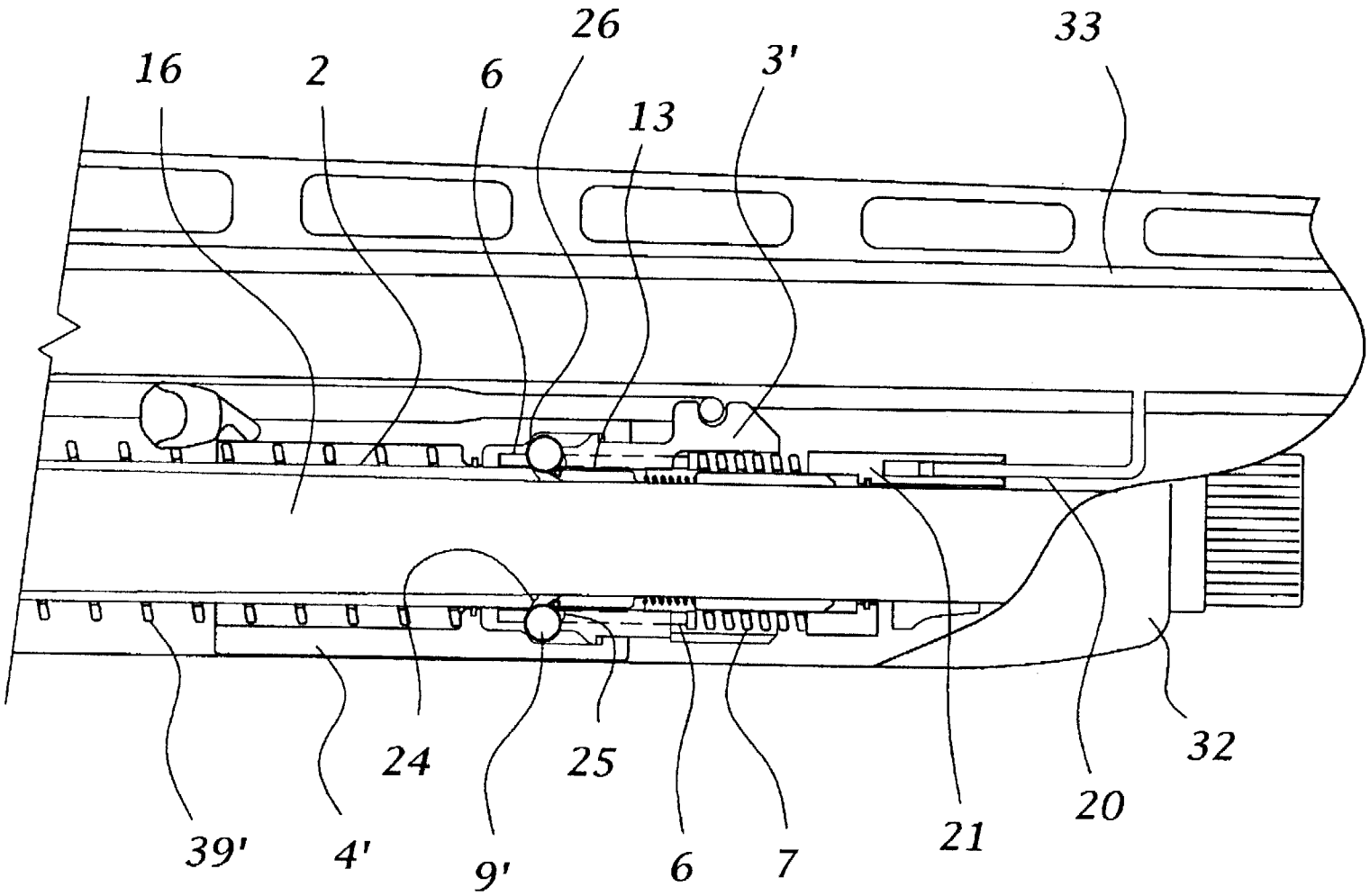
FIG. 18*b* is an enlarged view of a portion forestock showing the radial ball lock-up device of FIG. 18*a;*

FIGS. 17, 18*a* and 18*b* illustrate a side view of the firearm equipped with a radial ball lock-up device according to the second embodiment disposed in the forestock of the firearm. As shown in FIGS. 18*a* and 18*b*, the forestock 32 of the firearm is provided with a shaft member 16 extending therethrough. An inner lock sleeve 2' is disposed radially outward from the shaft member 16. The inner lock sleeve 2' is provided with a ball contact surface 24. An outer lock sleeve 3' is disposed radially outward from the inner lock sleeve 2'. The outer lock sleeve 3' is provided with ball contact surfaces 25. A plurality of lock balls 9' are provided for engaging the inner lock sleeve 2' with the outer lock sleeve 3'. A cam member 4' is provided radially outward of the inner and outer lock sleeves 2', 3'. The cam member 4' is provided with a cam surface 26. The inner lock sleeve 2' is provided with spring biasing means 13 for biasing the lock balls 9' from engagement between the inner lock sleeve 2' and the outer lock spring 3'. An actuator rod 6 extends from the cam member 4' to a cam spring 7 which is provided at a forward position coaxial with the shaft member 16. A recoil spring 39' is disposed in a rearward position coaxial with the shaft member 16. A connector member 5 is connected to the outer lock sleeve 3' and the breach bolt 102.

The operation of the locking device as shown in FIGS. 17 and 18 will now be discussed. In operation, the trigger 36 is pulled backward, releasing the hammer 37. The hammer 37 springs forward, striking the firing pin 41, causing ammunition cartridge 42 to erupt, thereby discharging projectile 43 along the length of the barrel 33. The barrel 33 and the outer lock sleeve 3' are subject to a recoil force, which causes the barrel 33 and outer lock sleeve 3' to move rearward relative to the cam member 4'. This relative movement causes the cam spring 7 to compress at first, thus storing inertia energy.

The cam spring 7 subsequently decompresses, forcing the cam member 4' to slide rearward relative to the inner and outer lock sleeves 2' and 3', and allowing the lock balls 9' under the force of spring member 13, to disengage from the locking position. As the lock balls 9' are biased by the leaf spring 13 into the cam groove 26, the outer lock sleeve 3' is free to move relative to the inner lock sleeve 2'.

During the cycling phase, the cam member 4' and the outer lock sleeve 3' are locked together by lock balls 9'. The cam member 4' presses against the recoil spring 39, causing the recoil spring 39' to contract. When the outer lock sleeve 3' reaches a furthest rearward position, the connector member 5 has fully opened the breech bolt 102. At this time, the spent ammunition cartridge 42 is ejected by the ejector and extractor members 44 and 45, respectively, through an opening in the receiver portion 38 of the firearm 30, by methods which are known. The new ammunition cartridge is then reloaded, by means which are known, and the recoil spring 39' forces the cam member 4' to move the cam member 4' and the outer lock sleeve 3' to the forward position. When the outer lock sleeve 3' has reached its original position, the recoil spring 39 which is still under load, biases the cam member 4' to move forward, thereby forcing the radial balls 9' up the cam surfaces 26 and into the locking position between the inner sleeve 2' and the outer lock sleeve 3'.

Figure 19:
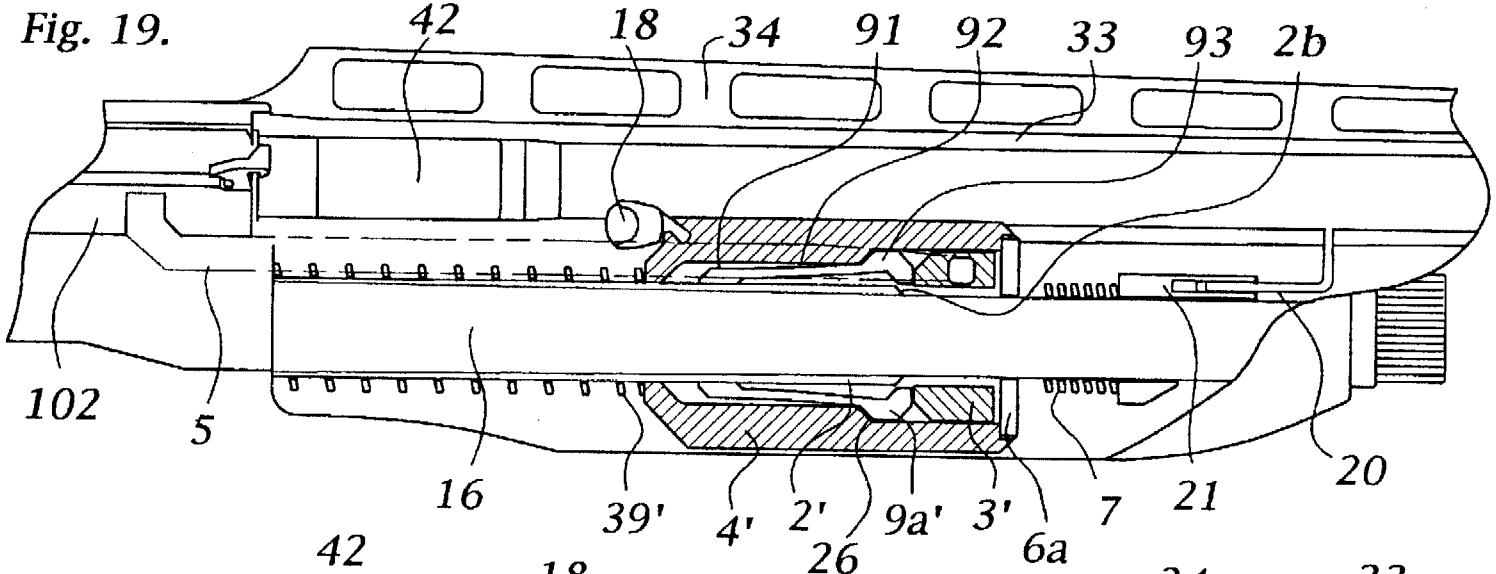
FIG. 19 is a side view of a shotgun having a spring-finger type lock-up device according to the third embodiment of the present invention disposed in the forestock of the firearm.

FIG. 19 is a side view of a firearm having a spring-finger-type lock-up device according to the third embodiment of the present invention disposed in the forestock of the firearm. In this embodiment, the inner lock sleeve 2' is disposed around the shaft member 16. A spring-finger abutting portion 2*b* is provided on lock sleeve 2'. The lock-up device 9*a*' includes a sleeve portion 91, a spring-finger portion 92 which is biased to spring radially outward, and locking elements 93 disposed at the ends of the spring-finger portions 92. The cam member 4' biases the spring-fingers 9*a*' into a locked position between the inner lock sleeve 2' and the outer lock sleeve 3'. An actuator ring 6*a* is provided between the cam member 4' and the cam spring 7. With respect to the remaining elements, they are substantially the same as in the embodiment shown in FIG. 18*a*.

The operation of the third embodiment of FIG. 19 will now be described. In operation, the trigger 36 is pulled backward, releasing the hammer 37. The hammer 37 springs forward, striking the firing pin 41, causing ammunition cartridge 42 to erupt, thereby discharging projectile 43 along the length of the barrel 33. The barrel 33 and the outer lock sleeve 3', which are subject to a recoil force, cause the barrel 33 and outer lock sleeve 3' to move rearward relative to the cam member 4'. This relative movement causes the cam spring 7 to compress at first, thus storing inertia energy.

The cam spring 7 subsequently decompresses, forcing the cam member 4' to slide relative to the inner and outer lock sleeves 2' and 3', and allowing the spring-fingers 9a' to disengage from the locking position under the spring force of the spring-finger portion 92. As the locking element 93 is moved out of engagement between the inner lock sleeve 2' and the outer lock sleeve 3', the outer lock sleeve 3' is free to move relative to the inner lock sleeve 2'.

During the cycling phase, the cam member 4' and the outer lock sleeve 3' are locked together by 6a which is interconnected with 4'. The cam member 4' presses against recoil spring 39', causing the recoil spring 39' to compress. When the outer lock sleeve 3' reaches a furthest rearward position, the connector 5 has completely opened the breech bolt 102, and the spent ammunition cartridge 42 is ejected by the ejector and extractor members 44 and 45, respectively, through an opening in the receiver portion 38 of the firearm 30, by methods which are known. The new ammunition cartridge is then reloaded, by methods which are known, and the recoil spring 39' forces the cam member 4' and outer lock sleeve 3' to move forward. When the outer lock sleeve 3' has reached its original position, the recoil spring 39 which is still underload, biases the cam member 4' to move forward, thereby causing the cam surface 26 of the cam member 4' to bias the locking element 93 into the locking position between the inner lock sleeve 2' and the outer lock sleeve 3'.

Figure 20:
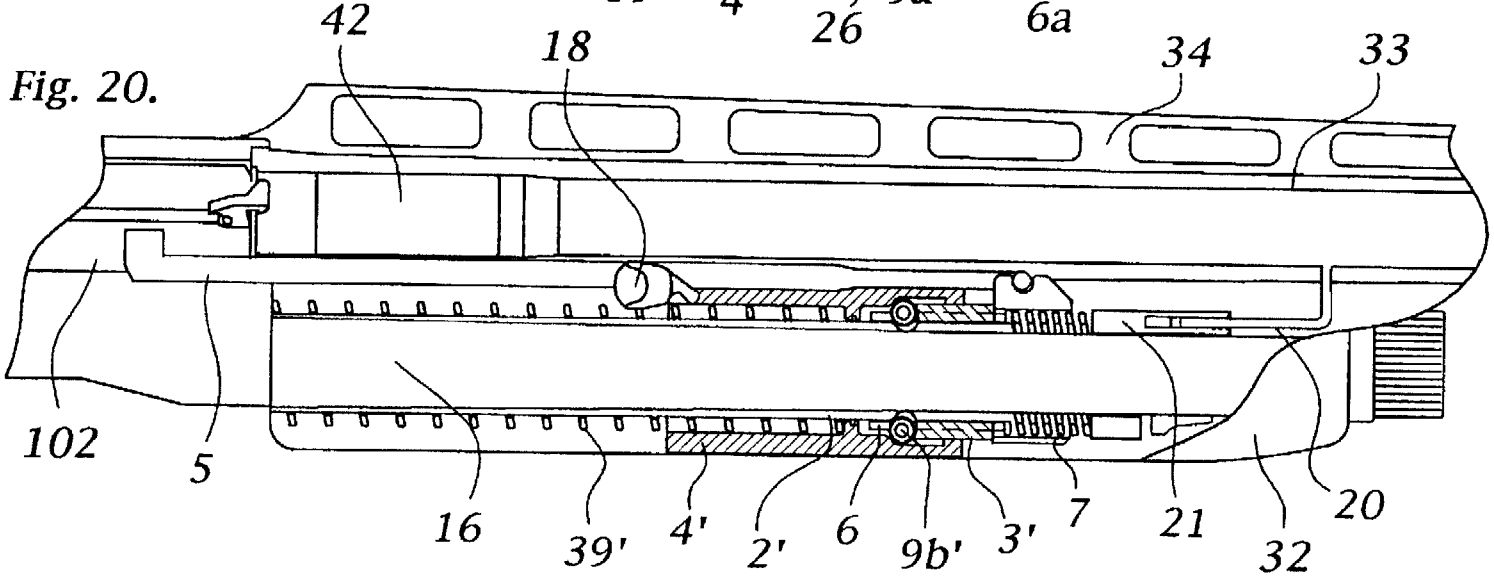
FIG. 20 is a side view of a shotgun having a roller-type lock-up device according to the fourth embodiment of the present invention disposed in the forestock of the firearm.

FIG. 20 is a side view of a firearm having a roller-type lock-up device according to the fourth embodiment of the present invention disposed in the forestock of the firearm. This device is substantially the same as the device shown in FIGS. 18a and 18b which utilizes radial lock balls 9', except the radial lock balls 9' have been replaced with cam rollers 9b'. Aside from the use of cam rollers 9b' in place of the lock balls 9' the function of the device of FIG. 20 is the same as that of FIGS. 18a and 18b.

Figure 21:
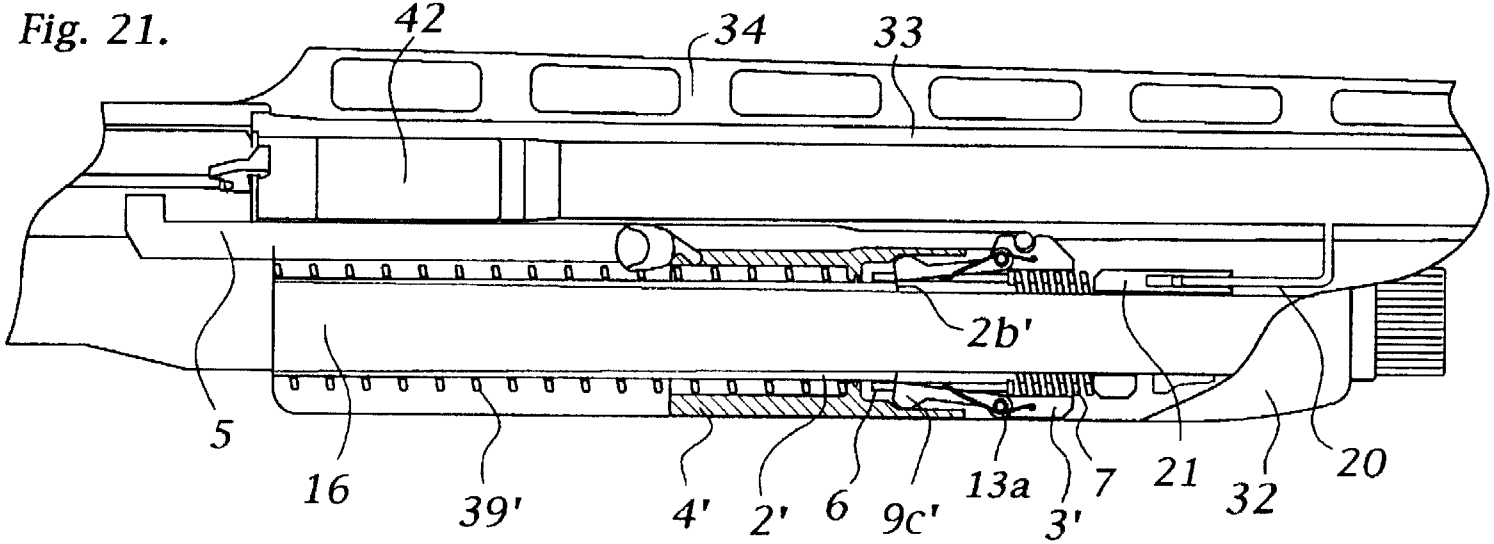
FIG. 21 is a side view of a shotgun having a toggle lug type lock-up device according to the fifth embodiment of the present invention disposed in the forestock of the firearm.

FIG. 21 is a side view of a firearm having a toggle lug-type lock-up device according to the fifth embodiment of the present invention disposed in the forestock of the firearm. In this embodiment, the inner lock sleeve 2 is disposed around the shaft 16. A plurality of toggle lugs 9c' are pivotally attached to the outer lock sleeve 3'. The inner lock sleeve 2' is provided with a radial surface 2b' for lock-up contact with the toggle lug 9c'. The cam member 4' is provided with a cam surfaces for receiving the toggle lug 9c' therein. A biasing spring 13a is provided to bias the toggle lugs 9c' radially outwardly.

The operation of the fifth embodiment of FIG. 21 will now be described. In operation, the trigger 36 is pulled backward releasing the hammer 37. The hammer 37 springs forward striking the firing pin 41 causing ammunition cartridge 42 to erupt. This eruption will discharge projectile 43 along the length of the barrel 33. The barrel 33 and the outer lock sleeve 3' are subject to a recoil force. This will cause the barrel 33 and outer lock sleeve 3' to move rearward relative to the cam member 4'. This relative movement causes the cam spring 7 to first compress thus storing inertia energy.

The cam spring 7 subsequently expands forcing the cam member 4' to slide relative to the inner and outer lock sleeves 2' and 3'. This will cause toggle lugs 9c' under the force of spring 13a to disengage from the locking position. As the toggle lugs 19c' are biased by the spring 13a' in the cam groove, the outer lock sleeve 3' is free to move relative to the inner lock sleeve 2'.

During the cycling phase, the cam member 4' and outer lock sleeve 3' are locked together through the connecting member 5. The cam member 4' becomes engaged with the connecting member 5, which is interconnected to the outer lock sleeve 3'. The recoil rod 40 presses against recoil spring 49 causing the recoil spring 39 to contract. When the outer lock sleeve 3' reaches a furthest rearward position, the spent ammunition cartridge 42 is ejected by the ejector and extractor means 44 and 45, respectively, through an opening in the receiver portion of the firearm 30 by a known method. A new ammunition cartridge is then reloaded by a known method and the recoil spring 39 will force the recoil rod 40 to move the cam member 4' and the outer lock sleeve 3' to a forward position. When the outer lock sleeve 3' has reached its original position, the recoil spring 39 is still under a load. This recoil spring 39 will further bias the cam member 4' to more forwardly. This will thereby force the toggle lugs 9c' into the locking position against the radial surface 2b' of the inner lock sleeve 2'.

Figure 22:
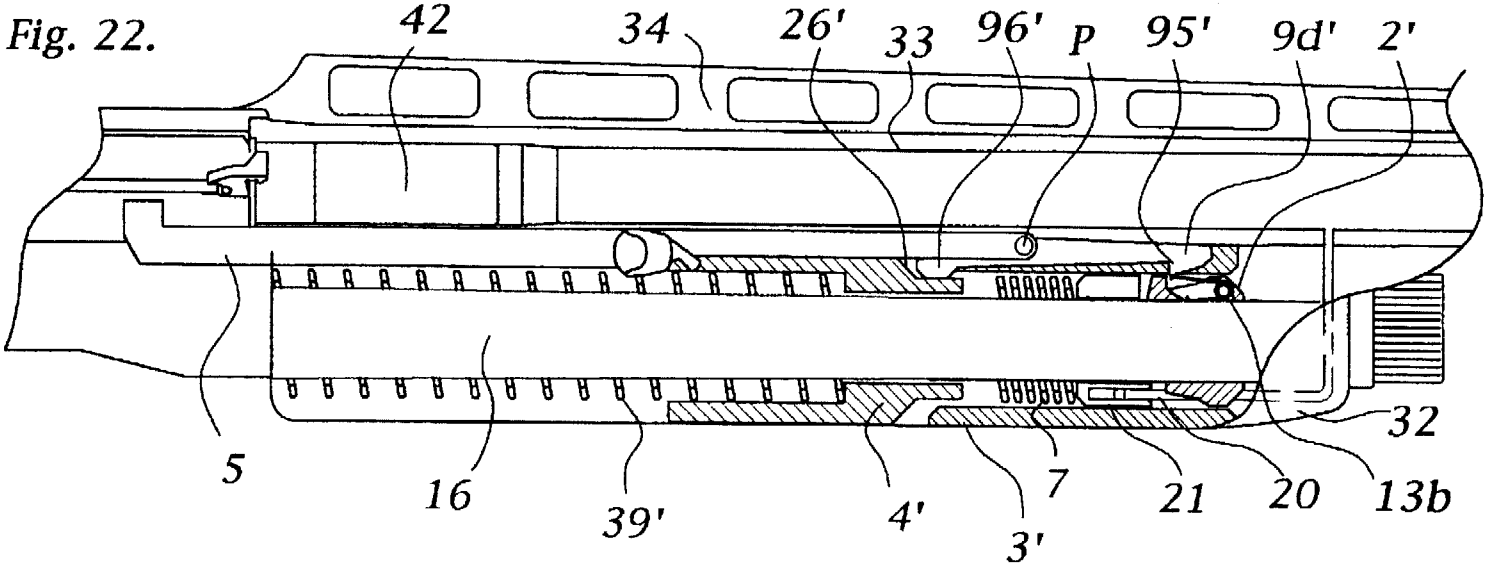
FIG. 22 is a side view of a shotgun having a lever-type lock-up device according to the sixth embodiment of the present invention disposed in the forestock of the firearm.

Turning now to FIG. 22, a side view of a firearm having a lever-type lock-up device according to the sixth embodiment of the invention is shown disposed in the forestock of the firearm. In this embodiment, a U-shaped lock-up device 9d' is pivotally mounted at pin P. Only one side of the lock-up device 9d' is shown in FIG. 22.

In the embodiment of FIG. 22, the inner lock sleeve 2' is provided with a recess. This recess receives the hook portion 95' of the lever-type lock-up device 9d'. The bottom cross member 96' of the U-shaped lock-up device 9d' engages a camming surface 26' of cam member 4'.

The operation of the embodiment of FIG. 22 will now be described. The trigger 36 is initially pulled backward thereby releasing hammer 37. The hammer 37 springs forward, striking the firing pin 41, causing ammunition cartridge 42 to erupt. This eruption will discharge projectile 43 along the length of barrel 33. The barrel 33 and the outer lock sleeve 3' are subject to a recoil force which is equal and opposite to the force exerted on the projectile 43. This force causes the barrel 33 and the outer lock sleeve 3' to move rearward relative to the cam member 4'. This relative movement causes the cam spring 7 to initially compress thereby storing inertia energy. The cam spring 7 subsequentially decompresses forcing the cam member 4' to slide rearward relative to the inner and outer lock sleeves 2' and 3'. Sliding of the cam member 4' allows the lock-up device 9d' under force of spring 13b to pivot about pin P. The cam surface 26' of the cam 4' will engage the bottom cross member 96' of the lever-type lock-up device 9d'. Accordingly, the forward end of the lock-up device 9d' will disengage from the recess of the inner lock sleeve 2'. As the lever-type lock-up device 9d' is pivoted about pin P, the outer lock sleeve 3' is free to move relative to the inner lock sleeve 2'.

During the cycling phase, the cam member 4' and outer lock sleeve 3' are lock together through the connecting member 5. The cam member 4' becomes engaged with the connecting member 5, which is interconnected to the outer lock sleeve 3'. The recoil rod 40 presses against recoil spring 39, causing the recoil spring 39 to contract. When the outer lock sleeve 3' reaches a furthest rearward position, the spent ammunition cartridge 42 is ejected by known means. A new cartridge is also loaded by known means. The recoil spring 39 will force the recoil rod 40 to move the cam member 4' and outer lock sleeve 3' forwardly. When the outer lock sleeve 3' has reached its original position, the recoil spring 39 will still be under a load. This will bias the cam member 4' forwardly thereby causing the lever-type lock-up device 9*d'* to move into the recess of the inner lock sleeve 2'.

It should be noted in each of the embodiments 18–22, that a gas port 20 is shown. This gas port 20 can be omitted if so desired. The gas port will enable gas in barrel 33 to create a forward pressure force on a gas block to in turn cause gas piston to move rearward and exert a compression force on cam spring 7. When smaller ammunition cartridges are used, the additional compression force applied to cam spring 7 is sufficient to assist the various embodiments of the lock-up device in cycling the firearm. The complete cycles of these embodiments are basically the same as those of the embodiments of FIGS. 8–9, respectively, for example. Therefore, a complete description of this gas port 20 and associate structure is now omitted.

Having thus described the invention several of the operating features of the invention will now be described. First, the lock-up device of the present invention is self adjusting for varied recoil. In other words, if the recoil is relatively large, due to a more powerful ammunition cartridge, the lock balls 9 are retained in the lock-up position for a longer period of time while the cam spring 7, 7' is further compressed and thus absorbs the higher inertial force.

Second, the lock-up device of the present invention comprises a sealed universal unit with the seals 10, 12 and 15 operating to protect the lock-up mechanism from debris, which has been a considerable problem in the prior art.

Third, the invention as described allows the inner lock sleeve 2, 2' and outer lock sleeve 3, 3' to be made of compressive quality materials such as ceramics. This is a significant departure from previous designs which require tensile and shear quality materials such as steel. The use of ceramics can reduce material and manufacturing costs.

Finally, the invention allows cycling of the mechanism by linear inertial guidance by use of a mechanism which is much less complex than known rotational cycling mechanisms.

The invention being thus described, it will be obvious that the same may be varied in many ways. Such variations are not to be regarded as a departure from the spirit and scope of the invention, and all such modifications as would be obvious to one skilled in the art are intended to be included within the scope of the following claims.

I claim:

1. A breech bolt lock-up release and cycling mechanism, for use in a firearm, comprising;

an inner lock sleeve;

an outer lock sleeve axially aligned with said inner lock sleeve;

locking means for releasably locking said inner lock sleeve with said outer lock sleeve;

a cam member axially aligned with said inner lock sleeve and said outer lock sleeve, and engagable with said locking means for releasing engagement between said inner lock sleeve and said outer lock sleeve, said cam member linearly reciprocates in a forward and rearward direction relative to a gun barrel;

a cam spring for storing linear inertia energy when said cam member moves forward; and a recoil spring for storing linear inertia energy when said cam member moves rearward.

2. The breech bolt lock-up release and cycling mechanism according to claim 1, wherein said locking means includes a plurality of spring fingers each having a locking element disposed on an end thereof for preventing relative movement between said inner and outer lock sleeves.

3. The breech bolt lock-up release and cycling mechanism according to claim 2, wherein the cam member is between the inner lock sleeve and the outer lock sleeve and wherein the spring fingers are interconnected by a sleeve portion, the sleeve portion being at end of the spring fingers opposite to the locking elements, the locking elements in a locked position being disposed between the outer lock sleeve and the inner lock sleeve and abutting the inner lock sleeve at an abutting portion, the locking elements being disengaged from the abutting portion of the inner lock sleeve by axial movement of the cam member, the inner lock sleeve and the outer lock sleeve being movable relative to one another when the locking elements are disengaged from the abutting portion of the inner lock sleeve and the outer lock sleeve being fixed relative to one another when the locking elements are in the locked position.

4. The breech bolt lock-up release and cycling mechanism according to claim 1, wherein said locking means includes at least two rollers and said inner and outer lock sleeves each include a pair of roller contact surfaces engagable by the rollers.

5. The breech bolt lock-up release and cycling mechanism according to claim 4, wherein the at least two rollers are rotatable about a vertical axis and wherein the at least two rollers are movable toward and away from the cam member.

6. The breech bolt lock-up release and cycling mechanism according to claim 1, wherein said locking means includes at least one toggle lug pivotably attached to said inner lock sleeve and engagable with a recess in said outer lock sleeve.

7. The breech bolt lock-up release and cycling mechanism according to claim 6, wherein each of the at least one toggle lugs has a v-shaped configuration, one end of the toggle lug being pivotably attached to the inner lock sleeve, the cam member further having a plurality of cam surfaces for receiving the toggle lug, axial movement of the cam member disengaging the toggle lug from a locked position and moving the toggle lug into a cam groove formed by the plurality of cam surfaces, the inner lock sleeve and outer lock sleeve being fixed relative to one another when the toggle lug is in the locked position and being movable relative to one another when the toggle lug is received in the cam groove, the toggle lug being pivoted about a pivot at the one end thereof during movement between the locked position and receipt in the cam groove, the toggle lug engaging recesses in the outer sleeve when in the locked position.

8. The breech bolt lock-up release and cycling mechanism according to claim 1, wherein said locking means includes a lever lock-up device pivotably attached to said cam member and engagable at one end with said cam member and at a second end with a recess in said outer lock sleeve.

9. The breech bolt lock-up release and cycling mechanism according to claim 8, wherein the lever lock-up device has a u-shaped configuration with two arm members interconnected by a bottom cross member, the bottom cross member being the end engagable with the cam member, each of the two arms having an end with a hook portion thereon, the hook portions being engagable in the recess in the outer lock sleeve, the lever lock-up device being pivotable about a pin extending through the two arms, initial axial movement of the cam member camming the lever hook lock-up device to pivot about the pin thereby removing the hook portions from the recess in the outer lock sleeve whereby the inner lock sleeve is movable relative to the outer lock sleeve.

10. The breech bolt lock-up release and cycling mechanism according to claim 1, wherein said inner lock sleeve is a breech bolt.

11. The breech bolt lock-up release and cycling mechanism according to claim 1, wherein said breech bolt lock up device is disposed on a forestock of the firearm.

12. The breech bolt lock-up release and cycling mechanism according to claim 11, wherein said locking means includes a plurality of spring fingers each having a locking element disposed on an end thereof for preventing relative movement between said inner and outer lock sleeves.

13. The breech bolt lock-up release and cycling mechanism according to claim 11, wherein said locking means includes at least two rollers and said inner and outer lock sleeves each include a pair of roller contact surfaces engagable by the rollers.

14. The breech bolt lock-up release and cycling mechanism according to claim 11, wherein said locking means includes a toggle lug pivotably attached to said outer lock sleeve and engagable with a recess in said inner lock sleeve.

15. The breech bolt lock-up release and cycling mechanism according to claim 11, wherein said locking means includes a lever lock-up device pivotably attached to said cam member and engagable at one end with said cam member and at a second end with a recess in said inner lock sleeve.

16. The breech bolt lock-up release and cycling mechanism according to claim 11, further comprising connector means for connecting said outer lock sleeve to the breech bolt.

17. The breech bolt lock-up release and cycling mechanism according to claim 1, wherein said cam member is made of a heavy metal selected from the group consisting of tungsten, depleted uranium and iridium.

18. The breech bolt lock-up release and cycling mechanism according to claim 1, wherein said cam member is disposed radially inside of said inner lock sleeve.

19. The breech bolt lock-up release and cycling mechanism according to claim 1, further comprising a gas assist device, the gas assist device includes a port provided in the gun barrel, a gas block disposed radially outwardly and forwardly of the gas port and a gas piston engaging the gas block and connecting the gas block to the cam member.

20. The breech bolt lock-up release and cycling mechanism according to claim 1, wherein the lock-up mechanism is contained within a sealed unit which is protected from debris.

* * * * *